United States Patent [19]

Pearce

[11] 3,974,600

[45] Aug. 17, 1976

[54] MINIMUM INVENTORY MAXIMUM DIVERSITY BUILDING SYSTEM

[75] Inventor: Peter J. Pearce, Studio City, Calif.

[73] Assignee: Synestructics, Inc., Chatsworth, Calif.

[22] Filed: Mar. 25, 1974

[21] Appl. No.: 454,265

Related U.S. Application Data

[63] Continuation of Ser. No. 176,220, Aug. 30, 1971, abandoned.

[52] U.S. Cl. ..... 52/81; 52/237; 52/DIG. 10

[51] Int. Cl.[2] ..... E04B 1/32

[58] Field of Search ..... 52/80, 648, 650, 655, 52/81, 236, 237; 131/1, 4

[56] References Cited

UNITED STATES PATENTS

| | | | |
|---|---|---|---|
| 2,934,075 | 4/1960 | Richardson | 52/2 |
| 3,148,539 | 9/1964 | Cook | 52/DIG. 10 |
| 3,411,250 | 11/1968 | Maymont | 52/81 |
| 3,510,962 | 5/1970 | Sato | 52/DIG. 10 |
| 3,510,962 | 5/1970 | Kazuhsa | 52/DIG. 10 |
| 3,611,620 | 10/1971 | Perry | 52/81 |
| 3,632,109 | 1/1972 | Dattner | 52/DIG. 10 |
| 3,640,034 | 2/1972 | Shotwell | 52/70 |
| 3,646,718 | 3/1972 | McKenna | 52/79 |
| 3,665,882 | 5/1972 | Georgier | 52/DIG. 10 |
| 3,685,221 | 8/1972 | Mangan | 52/80 |
| 3,694,933 | 5/1970 | Busch | 52/DIG. 10 |
| 3,710,528 | 2/1971 | Riedberger | 52/79 |
| D191,438 | 4/1959 | Paalson | 52/237 |
| D195,762 | 7/1963 | Gersin | 52/81 |
| D218,459 | 8/1970 | Dattner | 52/DIG. 10 |

FOREIGN PATENTS OR APPLICATIONS

| | | | |
|---|---|---|---|
| 1,196,348 | 7/1965 | Germany | 52/81 |
| 1,818 | 12/1916 | Netherlands | 52/81 |

OTHER PUBLICATIONS

*Zome Primer;* c. 1970; pp. 2,4–8, 14, 20, 21.

*Mathematical Models* by Cundy & Rollett c. 1961 *Oxford University* Press, pp. 160, 195–198, 68, 69 84–86, 94, 101–105, 120, 144, 145–151, 121.

*Space Grid Structures* by J. Borrego c. 1968 MIT pp. 19, 104–107, 82, 83, 87, 133–138, 148, 157, 164–167, 192, 193.

*Order in Space* by Critchlow c. 1969 pp. 25, 47, 49, 51, 53 and appendix I and II.

*Dimensions Unlimited* Super Sky Products Inc. AIA File I2–J 1964.

Architectural Record Apr. 1958 pp. 245, 247, 249.

Regular Polytopes by HSM Coxeter 1963 MacMillan Mathematics Paperbacks pp. 152, 130, 25–27, 60, 61, 92, 243–249 & plates II–VIII.

*Primary Examiner*—Ernest R. Purser
*Assistant Examiner*—Henry Raduazo
*Attorney, Agent, or Firm*—Marvin H. Kleinberg

[57] ABSTRACT

A modular structural system utilizes a limited inventory of framework elements which in combination with a limited number of interstitial exterior and interior panels can be utilized to erect a variety of integral structures in which the framework elements bear substantially all loads. The same framework elements can be combined to form planar trusses and spans, domical space enclosing structures with integral foundations, and complex multi-level high rise structures. Polyhedral frameworks are assembled into arrays of interlinked triangulated segments for optimum stability.

89 Claims, 28 Drawing Figures

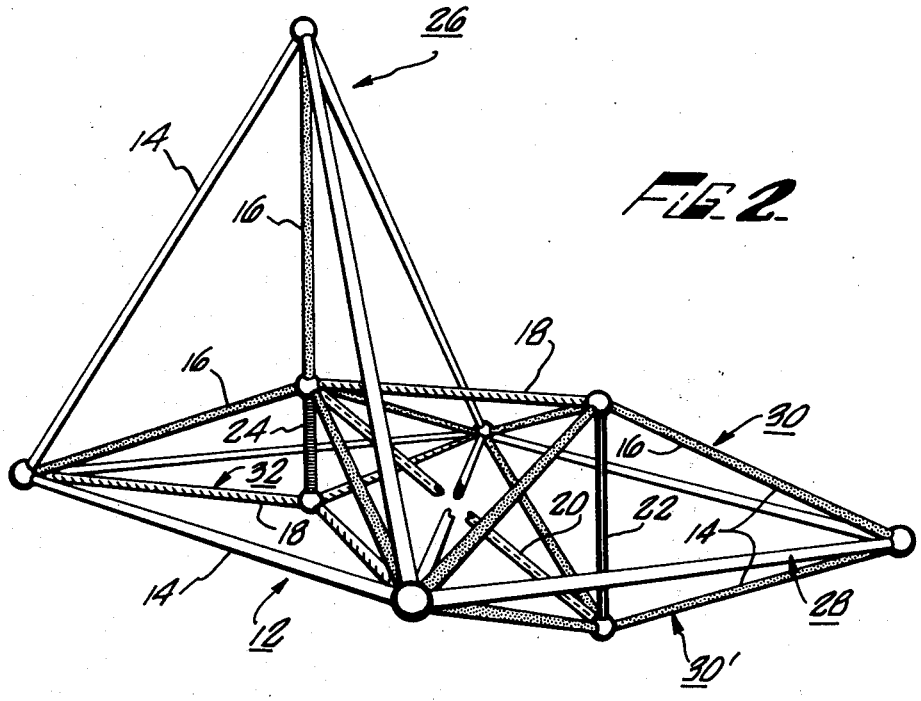
FIG. 2
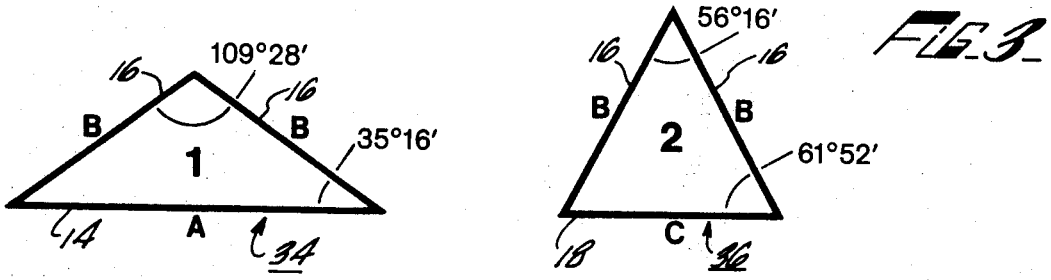
FIG. 3
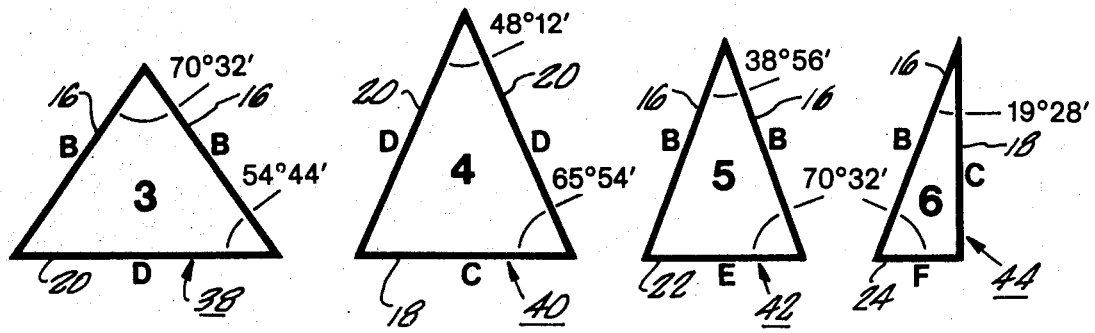
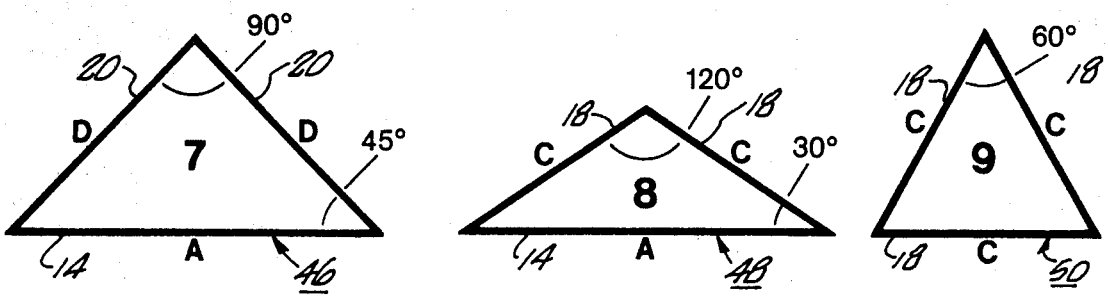

FIG. 4a
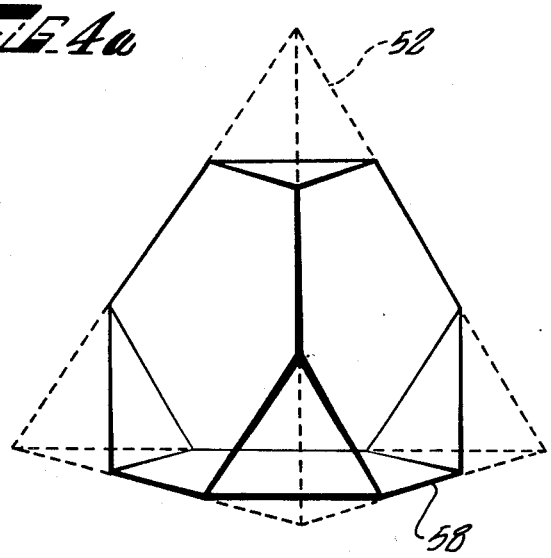
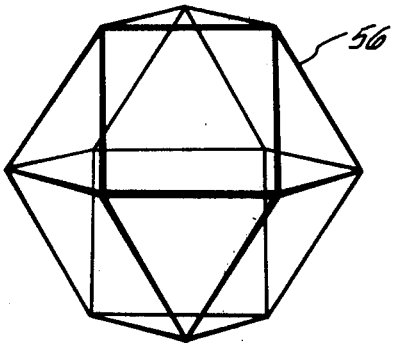
FIG. 4b
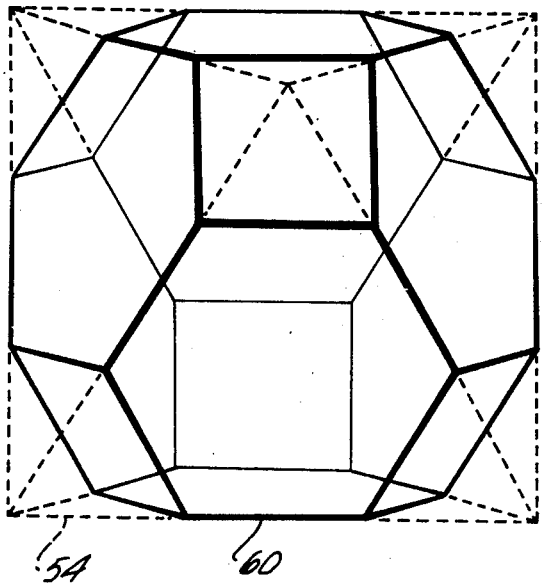
FIG. 4c

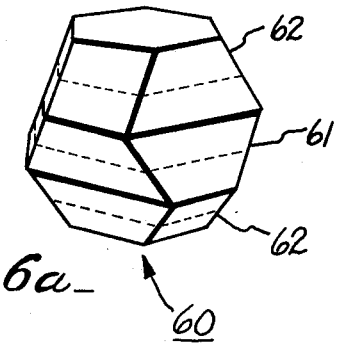
FIG. 6a
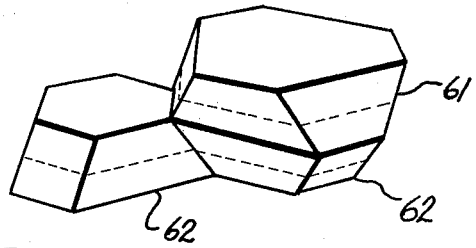
FIG. 6b
FIG. 6d
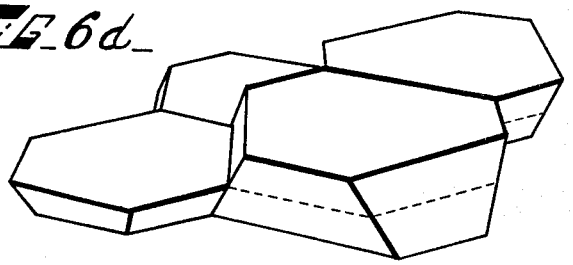
FIG. 6c
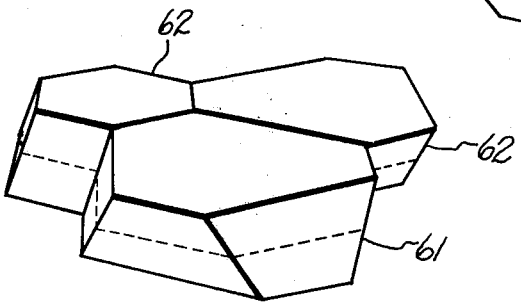
FIG. 6f
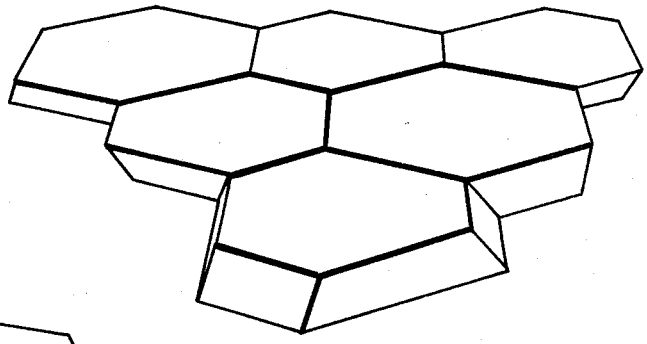
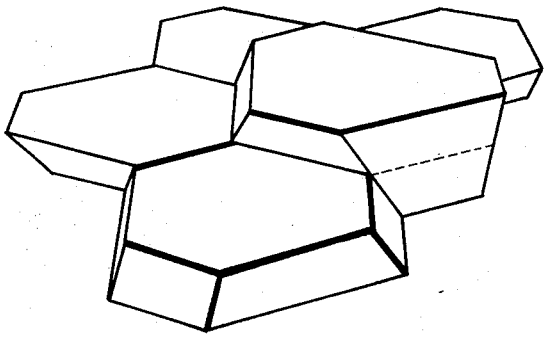
FIG. 6e 80
16
18
22

82
20
16
18

80
82
20
16
18
22

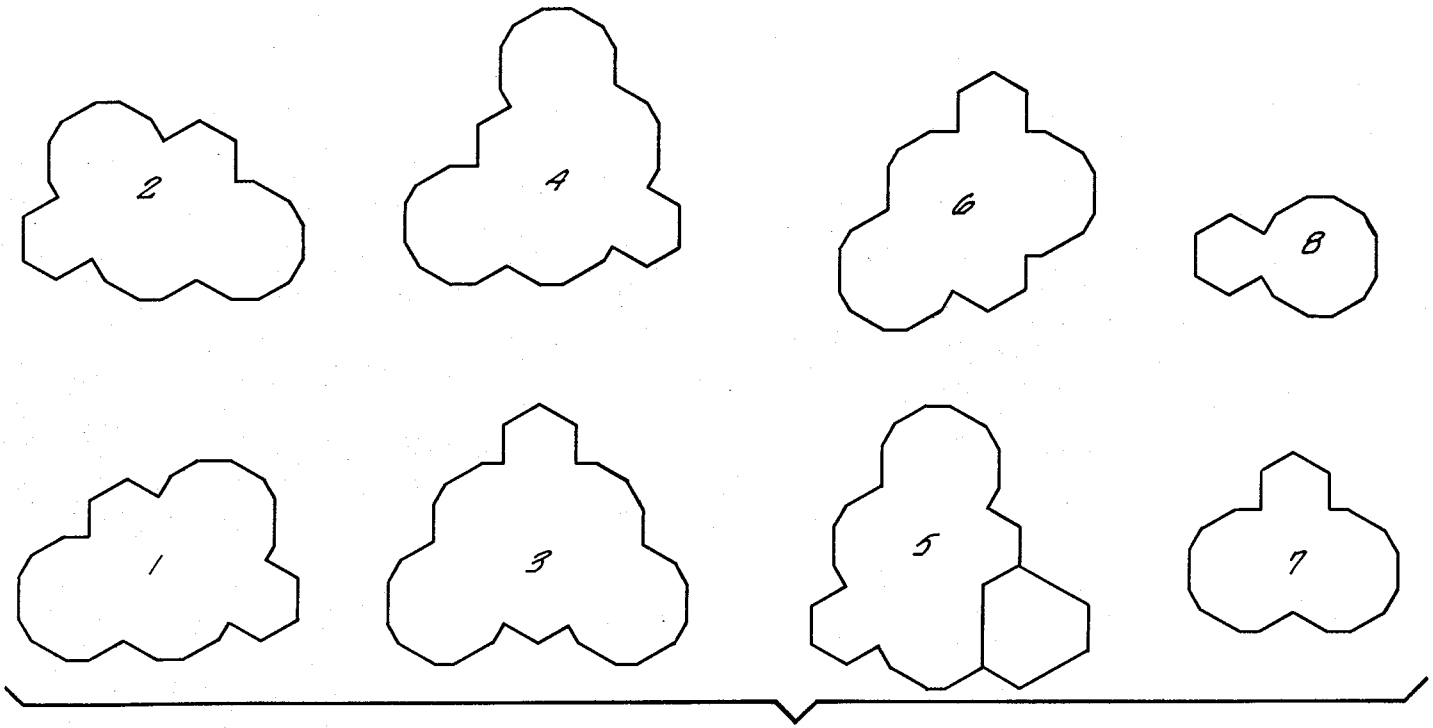
FIG. 28
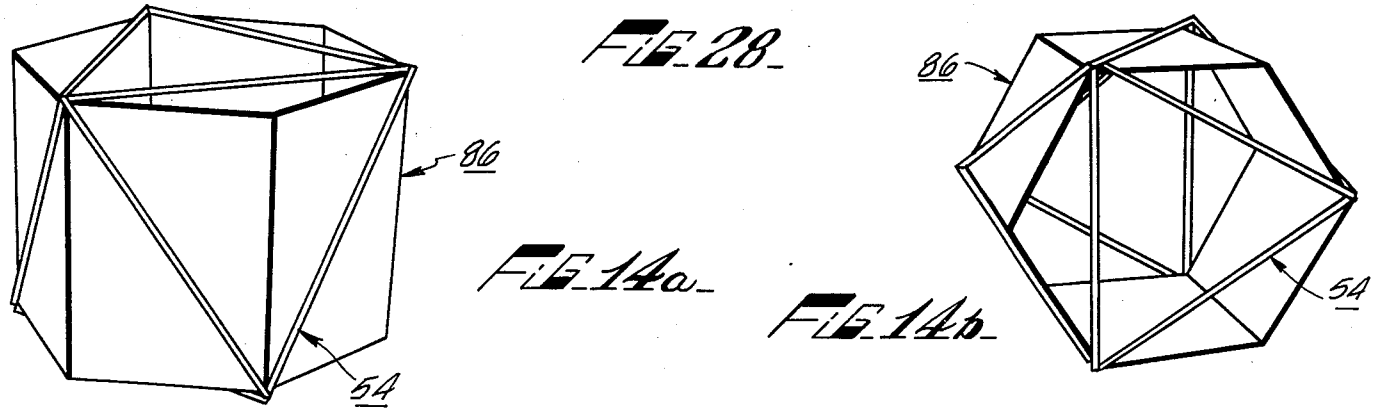
FIG. 14b
FIG. 14a

FIG. 20a.
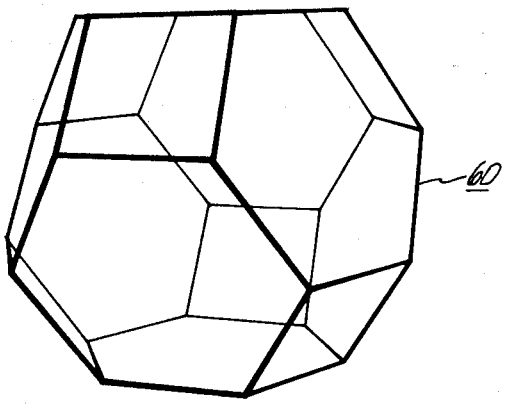
FIG. 20d.
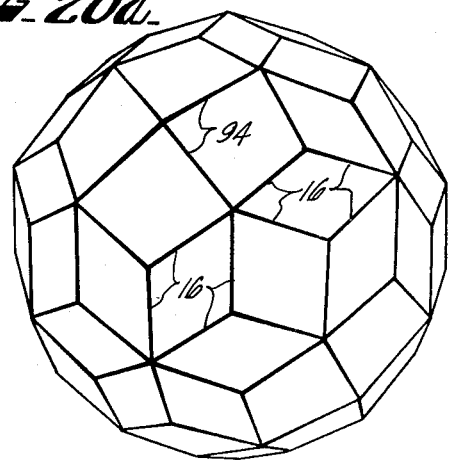
FIG. 20b.
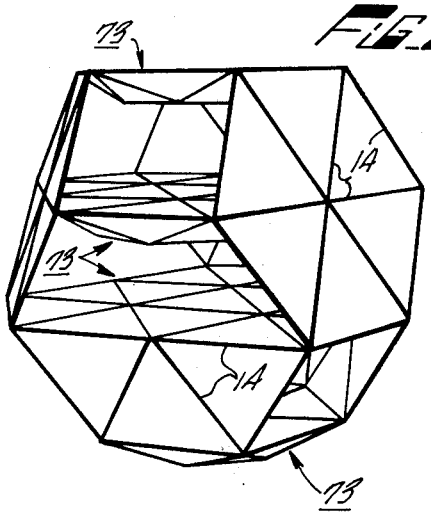
FIG. 20e.
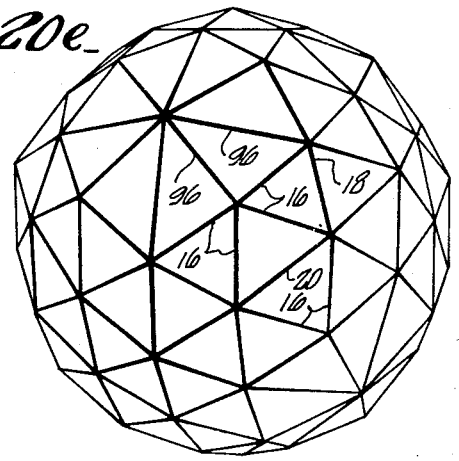
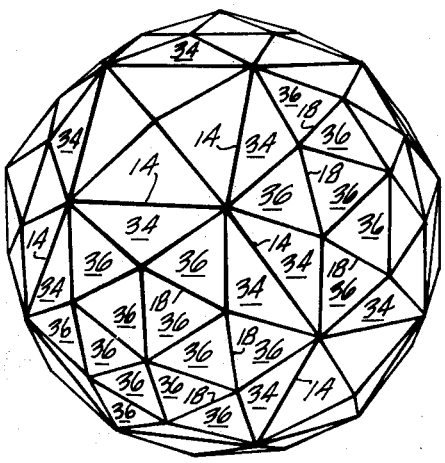
FIG. 20c.
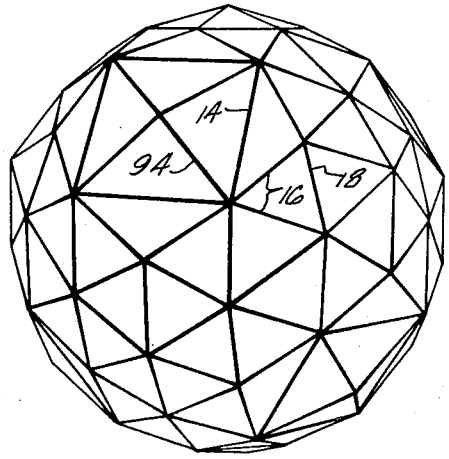
FIG. 20f.

1

2

3

MINIMUM INVENTORY MAXIMUM DIVERSITY BUILDING SYSTEM

This is a continuation of application Ser. No. 176,220, filed Aug. 30, 1971 now abandoned.

The present invention relates to construction systems and, more particularly structural systems utilizing a limited number of prefabricated components to achieve diverse structural combinations.

BACKGROUND OF THE INVENTION

The building industry and, in particular, the housing industry, remains anachronistic in the extreme as it fails to take any real advantage of the technological sophistication now available. Until recently, the profession of architecture has opposed the use of mass production techniques for building, arguing that the standardization principle which is the modus operandi of industrial production inevitably leads to a standardized uniform environment. As a consequence of their position they have almost totally avoided the problems of mass housing. The result of this is that housing has been left entirely to the local builder who is limited by old fashioned techniques and an accomodation to the need for diversity that is at best marginal.

Per capita resources are diminishing as the population continues to grow at an astonishing rate. This alone is a clear enough mandate for an economical use of natural resources. Both the short and long range costs of building increase. The short range cost is a function of both economy of means and resource utilization. The high range cost is primarily a function of the building industry's failure to recognize in any practical way the need for change. The principle of environmental adaptability as an economic advantage has not been understood. Total building costs should be based not only on original construction but upon the costs of subsequent change.

The industrial production principle of standardization is really a principle of economy, economy of means as well as economy of resource utilization. Although there are innumerable examples of the misuse of technology, there is ample enough evidence to show that well designed mass production techniques can produce more with less resources and in less time that any other alternative strategy. The task clearly becomes one of reconciling the principles of industrial production technique, i.e. standardization with the human and ecological realities of change and diversity.

In order to take best advantage of mass production techniques what is needed are systems which use standardized components, yet a set of such components is needed which can be combined in different ways to yield a great variety of alternative structures. What in fact is required are systems composed of minimum sets of component types which are designed in such a way that they may be combined and recombined into an endless diversity of form.

Modular structures can be defined in terms of volumes, surfaces, or linear frameworks. The latter is the more fundamental in a geometric sense, as surfaces can be defined by linear frames, and volumes can be defined by surfaces (and frames). Any framework must consist of nodes (or vertices) and branches (or edges). A framework is simply the interconnections of points in space with linear branches. In a physical structural system the points or nodes become connectors, and the branches become linear structural components or struts.

In addition to a consideration of the purely spatial properties of modular systems (be they frames, surfaces, or volumes) it is also necessary to study carefully the physical consequences of alternative spatial arrangements. In so far as framework structures are concerned, triangulated configurations give rise to the most efficient systems from the point of view of strength per unit of invested resources, i.e. strength per weight. This has been known to aircraft frame designers for many years. It is a point that has been recently poplularized by R. Buckminster Fuller with his geodesic domes.

It can easily be shown that the triangle is the only inherently stable linear framework. All other polygons with more than three sides are unstable. If a triangular frame is constructed in which all of its joints are hinges, it remains just as rigid as if its joints were fixed. If a square or any other polygon is constructed with hingeable joints, it will immediately collapse. Complex structures that are fully triangulated can be constructed with multi-directional hinges at each joint, yet they will remain completely rigid.

There is a two-fold economic advantage in inherently stable triangulated structures: first, their tendency to disperse concentrated and distributed loads over a very large part of the structure and, second, the fact that loads are distributed axially through the linear members. Both of these are ideal conditions for efficient use of materials.

When linear members are loaded axially along their lengths, they experience no bending, only pure compression or pure tension. With complex triangulated frameworks, the direction of loads become far less important than in the usual rectangular based structural design.

Prior art techniques have relied primarily upon a vertical and horizontal structural member to create buildings. Where necessary, framing members which include diagonal braces are added to provide lateral rigidity to the inherently non-rigid orthogonal frameworks. Triangulated structures are therefore the exception and there, general use has been limited.

Triangulated systems have not been used extensively in architectural structures, possibly because they are largely incompatible with the architectural profession's spatial sensibilities which appear to be dominated by right angles. Looking at space from a more fundamental and comprehensive point of view, a modular spatial approach can be found which can yield inherently stable, highly efficient, low redundancy structures based upon fully triangulated configurations.

Although such structures are derived primarily from triangular matrices, rather than eliminate the familiar 90° spatial possiblities, they have been augmented and redefined in such a way as to yield a vast array of new options for spatial planning.

One of the disadvantages of triangulated systems is the relatively complex nodes that are necessary for joining the many linear members that can frequently meet at a common point. This disadvantage can be overcome in the context of high volume industrial production. A sophisticated, specially designed joint system can then become economically feasible, which would not be the case if one were building a single structure or relatively small numbers of small-scale structures.

According to the present invention, a minimum inventory, maximum diversity building system includes a triangulated structural framing to which various interstitial panels are attached forming a space enclosing system, or a weather envelope. A basic framework is the precursor of the space enclosing panel system. In the preferred embodiment, the modular framework system consists of three primary and three secondary linear components which, in turn, combine in various ways to define a set of basic, interstitial panels.

The interrelatedness of the six linear components is shown in Table I below.

TABLE I

| | | | | |
|---|---|---|---|---|
| PRIMARY COMPONENTS | | | | |
| A | = | Unity | | |
| B | = | $A\sqrt{6}/4$ | = | .6123A |
| C | = | $A\sqrt{3}/3$ | = | .5774A |
| SECONDARY COMPONENTS | | | | |
| D | = | $A\sqrt{2}/2$ | = | .7072A |
| E | = | $A\sqrt{6}/6$ | = | .4082A |
| F | = | $A\sqrt{6}/12$ | = | .2041A |

The relative edge length ratios are given as functions of unit edge A. The A, B, and C components are considered primary, and the D. E. and F components are considered secondary by virtue of the frequency of their use. Note that these ratios are node center to node center distances and not actual component lengths, since the bulk of the nodal joints would have to be allowed for.

A plurality of triangular, interstitial panels can be defined by the linear components. The sides and various face angles are given in Table II below.

TABLE II

| Panel | Sides | Angles |
|---|---|---|
| PRIMARY PANELS | | |
| 1 | B·A·B | 35°16, 109°28′, 35°16′ |
| 2 | B·C·B | 61°51′, 56°16′, 61°52′ |
| SECONDARY PANELS | | |
| 3 | B·D·B | 54°44′, 70°32′, 54°44′ |
| 4 | D·C·D | 65°54′, 48°12′, 65°54′ |
| 5 | B·E·B | 70°32′, 38°56′, 70°32′ |
| 6 | B·F·C | 70°32′, 19°28, 90° |
| TERTIARY PANELS | | |
| 7 | D·A·D | 45° 90° 45° |
| 8 | C·A·C | 30° 120° 30° |
| 9 | C·C·C | 60° 60° 60° |

Like the linear components, these nine surfaces are ranked according to the frequency of their use. The linear members and these panels constitute components which relate to each other in periodic associations.

It is important to note that no particular scale has been assigned these components. The actual size of the members is determined by the spatial requirements of the given applications. The important thing in this concept is the relative metric and topological relations among the components. A few specific sizes emerge as the most appropriate accommodations of human scale.

Each panel can be produced as an opaque insulated surface, as a translucent surface for diffused lighting, or as a transparent window. In addition to these examples, it would also be possible to have panels of differing coefficients of reflectance of radiant energy. The linear framework structure is envisioned as a demountable system to facilitate both erection and change, and the panels are intended to be replaceable and changeable as well. This is possible because the integrity of the building structure is entirely in the frame. The panels are only required to resist local loads.

This simple collection of components can be assembled in great varieties of architectural configurations, including single story dome-like dwellings, and multilevel low and high rise structures. The system provides for the structural framework, the space enclosing and finishing surfaces, a partitioning system for interior space, and a flooring system including integral foundations. The application of such adaptable environmental systems will be found wherever high strength per weight, mass producible, economical, variable and diverse human environments are desirable.

The novel features which are believed to be characteristic of the invention, both as to organization and method of operation, together with further objects and advantages thereof will be better understood from the following description considered in connection with the accompanyng drawings in which several preferred embodiments of the invention are illustrated by way of example. It is to be expressly understood, however, that the drawings are for the purpose of illustration and description only and are not intended as a definition of the limits of the invention.

BRIEF DESCRIPTION OF THE DRAWINGS

FIG. 2 is a perspective view of an interconnected assemblage illustrating the fundamental components of the present invention;

FIG. 3 illustrates a plurality of panel members useful in the present invention;

FIG. 4, including FIGS. 4A, 4B and 4C, is an illustration of the preferred polyhedra which are employed in the system of the present invention;

FIG. 5, including

FIG. 6, including FIGS. 6A through 6F, inclusive, is a perspective view of a truncated octahedron being subdivided and rearranged to create a planar, space-filling combination;

FIG. 7, including

FIG. 8, including

FIG. 9, including FIGS. 9A, 9B and 9C, illustrates the development of a triangulated structure to impart rigidity to a regular hexagon in which FIG. 9A is an exploded view of the structure employed; FIG. 9B is an inverted view of the structure as a tetrahex truss; and FIG. 9C is a view of the structure as a hex dome;

FIG. 10, including

FIGS. 14*a* – 14*b* are a perspective view of a hexagonal prism included within an octahedron;

FIG. 15, including

FIG. 16, including

FIG. 17 is a floor plan of the structure of FIG. 1, utilizing a portion of the framing grid of FIG. 15;

FIG. 18, including

FIG. 19, including

FIG. 20, including FIGS. 20A through 20F, inclusive, illustrates the development of the complete truncated octahedron to various triangulated configurations;

FIGS. 22A through 22F illustrates the development of the combined polar and equatorial space units of the truncated octahedron;

FIG. 28 is a floor plan for each of the stories of the multistory structure of FIG. 27.

Figure 1:
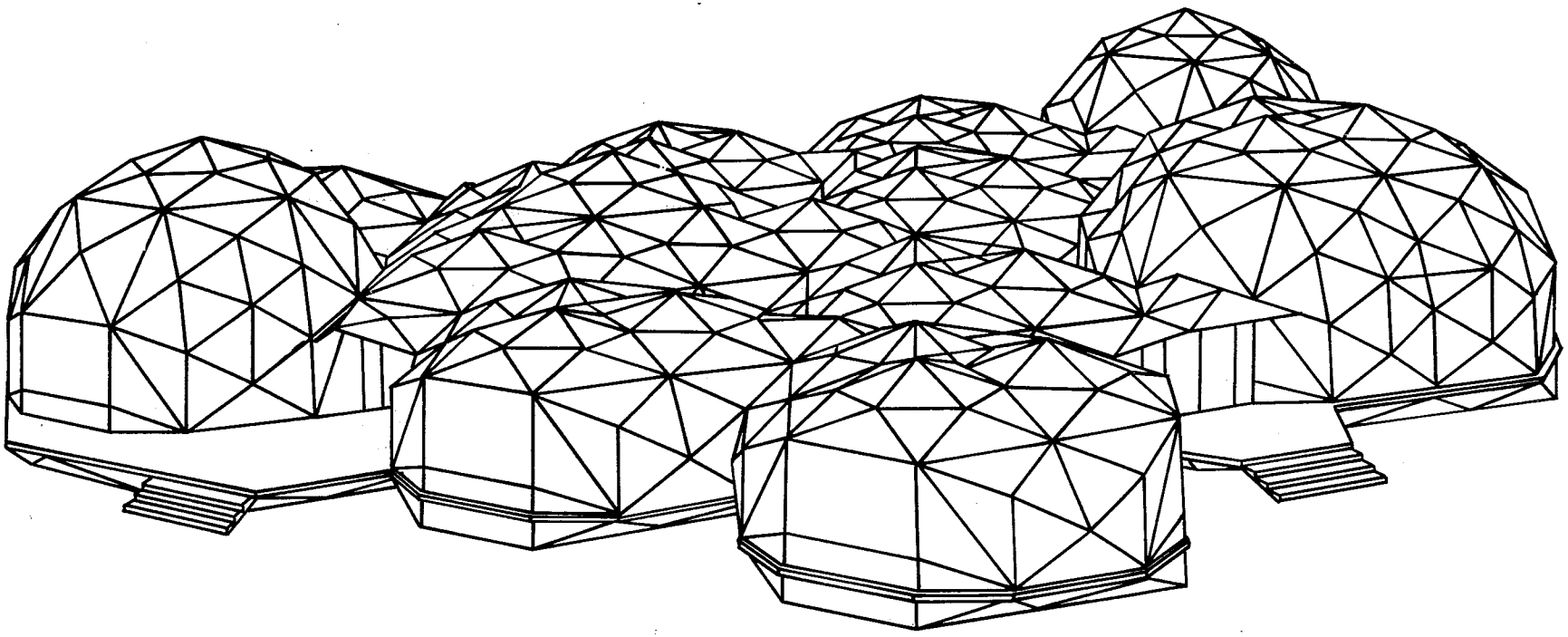
FIG. 1 is a perspective view of a structure in accordance with the teachings of the present invention.

Turning first to FIG. 1, there is illustrated a detailed scale model of a building 10 intended as a learning center. Although the particular functional constraints of a learning environment are quite different from that of housing, this example goes far in showing the general capabilities of the system, and illustrates the broad range of application of such systems. The model 10 is part of a proposed educational research and training center, as part of an ongoing learning environment for young children.

The system of the present invention is particularly well suited to this application.

With reference next to FIG. 2, there is shown an interconnected assemblage 12 of no particular utility other than to illustrate each of the interrelated struts or components which are fundamental to the system of the present invention and the structures that are formed therefrom. The primary components of the system and ones most frequently used, include the A component 14, and B component 16 and the C component 18. The dimension of these components have been set forth in Table I supra. The D, E and F components 20, 22, 24 are secondary components and are of less basic importance. Note that the F component 24 is exactly ½ of the E component 22, and exactly ⅓ of the B component 16.

At this point, it is interesting to note that six of the A components 14 combine to form a tetrahedron 26, and that the B component 16 is the angular bisector to the volumetric center of the tetrahedron 26.

When the A component 14 is assembled into an equilateral triangle 28, and pyramids 30, 30′ are formed using the B components 16, both above and below the triangel 28, the pyramids 30, 30′ apicces can be joined with an E component 22. If a triad 32 is formed coplanar with the base of the tetrahedron 26 utilizing C components 18 for edges, the controid of the tetrahedron 26 can be coupled to the apex of the triad 32 with an F component 24. A D component 20 joins the apex of the lower pyramide 30′ to the centroid of the tetrahedron 26.

It will, of course, be understood that FIG. 2 is intended only to indicate the interelationships of the various components and is not be be construed as a necessary or even useful structure in the context of the present invention. The structures that can result from the judicious employment of the various structural elements will be described in greater detail below.

In FIG. 3, there are shown interstitial panels that are formed by combinations of the structural elements of FIG. 2, above. The interstitial panels defined by these structural elements are not all of equal importance and are given numerical indicia for identification. Panels 1 and 2, 34, 36 constitute a primary set; panels 3–6, 38, 40, 42, 44 constitute a secondary set; and, panels 7–9, 46, 48, 50, comprise a tertiary set. The primary set of panels 1 and 2, 34, 36 in this case is all that is required to define the basic options, with the secondary panels 3–6, 38, 40, 42, 44 being useful ancillary components to the basic options. The tertiary panels 7–9, 46, 48, 50 can be used to extend the options available to the system.

It will be seen that each of the panels illustrated is defined by edges that are substantially coextensive with corresponding struts of FIG. 2. It is therefore possible to create structures in which panels of sufficient strengths can replace the struts which define the exterior edges of a spatial unit.

Now that the basic elements of the system have been identified, the manner in which the system works will be described below. This system can be combined in various ways to form a virtually infinite number of spatial options, limited only by certain modular constraints imposed by the system itself. In this respect it is a formative process much like that observed in the infinite variety of the snowflake, although the snowflake is governed by a much more constricted system.

The relationships of the six basic components illustrated in FIG. 2 do not even begin to suggest the kind of spatial arrangements that may ultimately be formed. Research in modular structures has suggested that a basic set of five space filling polyhedral volumes exists all of which are closely correlated to the set of five components. Three of these five polyhedra shown in FIG. 4 are the tetrahedron 52, the octahedron 54, and the cuboctahedron 56. The portions to be truncated are indicated in dashed outline and the solid lines remaining define a truncated tetrahedron 58, and the truncated octahedron 60. Of these, only the truncated octahedron 60 will fill space alone. The other polyhedra fill space only in various admixtures.

The truncated octahedron 60 is the simplest space filling system and, for this reason alone, it is the more useful system. Another important advantage is, that among uniform polyhedra, the truncated octahedron is the space filling system which contains the greatest volume with the least surface area. This was shown by Lord Kelvin in the late 19th century, and as a consequence this figure has been seen as an idealized form for cell shapes. The other polyhedra are, as a consequence, less important, although they are meaningful as they increase the spatial options in a fundamental way.

Figure 5B:
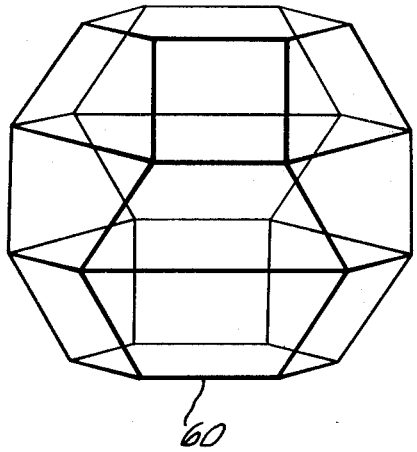
FIGS. 5A and 5B, is a diagram of a truncated octahedron assembled and subdivided into space-filling volumes.

With two exceptions, the various space filling arrangements of these polyhedra do not provide for continuous layers of parallel surfaces, which would be an essential requirement if floors for multilevel buildings are to be erected. For this reason, it is useful to subdivide three of the five polyhedra into fundamental space units. The truncated octahedron 60 can be conveniently divided into three space units, as illustrated in FIG. 5, which include FIGS. 5*a* and 5*b*.

Figure 5A:
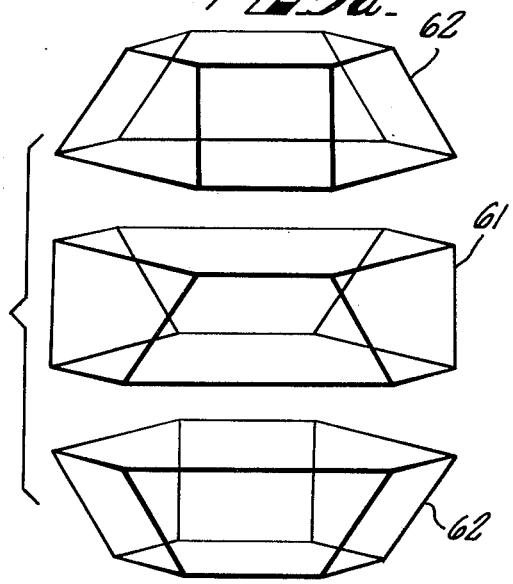

It will be noted that the truncated octahedron 60 of FIG. 5*a* is divisible into only two different space units: the central core or equatorial space unit 61 which is bounded by two hexagons, each with sides of one ($x$) and two ($2x$) units of length; and, by six trapezoids; and the two identical "polar" space units 62 that are each bounded by one equilateral hexagon, by one hexagon of sides ($x$) and ($2x$), by three trapezoids, and by three square faces.

The two space units that are derived by subdividing the truncated octahedron 60 will combine to fill all space. However, unlike the complete truncated octahedron 60, they can also "fill the plane". They become the basis of a system which relates space filling of truncated octahedra to a common plane of reference; and therefore allows infinite growth along a common plane.

FIG. 6 shows a space filling arrangement of a truncated octahedron 60 that incorporates into the array its two space units 61, 62 in order that the entire assembly may sit on a common plane. Without the inclusion of the space units 61, 62 this would be impossible. The parallel layers of "floors" are formed by the tiling of regular hexagons and hexagons with sides of ($x$) and ($2x$).

It is also possible to conveniently subdivide polyhedra into greater numbers of subunits. The truncated octahedron 60 may be easily divided into six space units of three different kinds. The FIGS. 6*d* and 6*f* show a sequence in which the truncated octahedron 60, divided into six space units, is incrementally rearranged to occupy a single, planar layer. It is obvious that this principle of subdivision could be increased to progressively higher frequencies, ad infinitum.

The truncated octahedron 60 is a unary space filling system. Tetrahedra 52 and octahedra 54 will combine, in a complementary fashion, to form a binary space filling system. Because this particular system can define parallel layers of surface, and because the altitudes of the tetrahedra and octahedra can be made equal to that of the basic space units of the truncated octahedron 60, there is no need to subdivide these polyhedra.

Figure 7B:
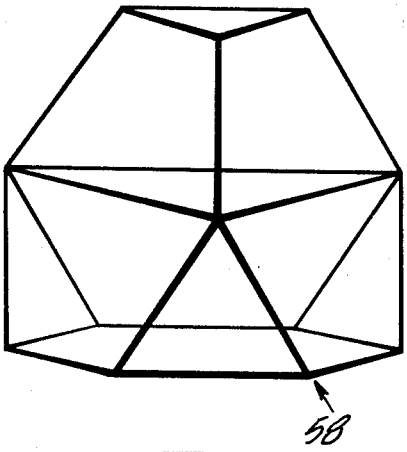
FIGS. 7A and 7B, illustrates a truncated tetrahedron and the division of the truncated tetrahedron into space-filling subunits.
Figure 7A:
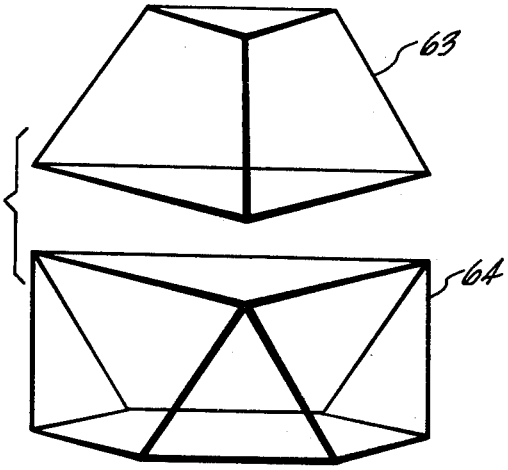

Turning next to FIG. 7, truncated tetrahedra 58 and tetrahedra 52 will also combine in a binary space filling system. Although this system will provide parallel layers of planes, it is useful to subdivide the truncated tetrahedron 58 into two space units in order to form parallel, continuous layers which are separated only by the altitude of a single tetrahedron of the same edge length. A first or truncated pyramid portion 63 has an upper and lower triangular base. The second portion 64 has a hexagonal face and a triangular face.

Figure 8B:
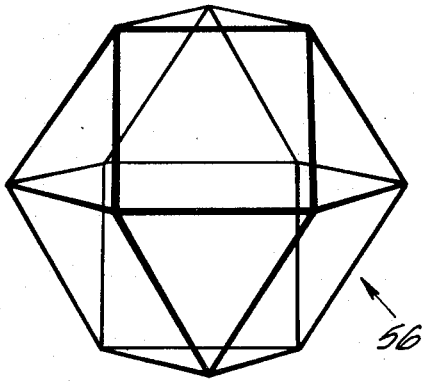
FIGS. 8A and 8B, is a diagram of a cuboctahedron and its division into two space units.
Figure 8A:
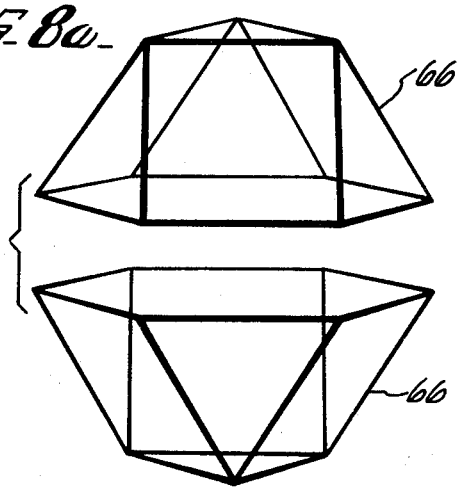

The cuboctahedron 56 divides into two identical space units 66 as shown in FIGS. 8*a* and 8*b*. The cuboctahedron space units 66 have a triangular base and a hexagonal base and alternating square and triangular faces.

In addition to the one unary and three binary systems, there is a single ternary space filling system. It is composed of truncated tetrahedra 58, cuboctahedron 56, and truncated octahedra 60. Since we have already subdivided the three polyhedra comprising this system, no new space units are generated. This ternary system completes the collection of space filling arrangements that incorporate exclusively the five polyhedra that are the volumetric modules from which the basic spatial vocabulary of the present invention is derived.

As noted above, three of these polyhedra subdivide to form a total of five basic space units, all equal in altitude to the simple tetrahedron 52 and octahedron 57. The truncated octahedron 60 gives rise to two space units; the truncated tetrahedron 58 gives rise to two space units; and the cuboctahedron 56 gives rise to a single space unit. This brings the total number of volumetric units to 10, comprising the five polyhdedra and the five space units.

The combinations and permutations possible with this collection of space cells is vast, yet they by no means constitute the spatial limits of the system. These are the most symmetrical cases and form an intelligible spatial vocabulary from which many other alternatives may be derived. These polyhedral space units are particularly useful for planning small structures or multilevel structures, where the accumulation of such volumes has importance.

It will be noticed that, with the exception of the tetrahedron 52 and octahedron 54, none of the polyhedra or space units described above are triangulated systems, and, therefore, form unstable frameworks. For this reason, reasonable ways must be found in which these spatial units may be triangulated. This is not such a difficult problem since the majority of the faces of the space units can be subdivided into equilateral triangles.

However, there is an important structural phenomenon that must be observed, and that can be easily discussed with reference to polyhedra. If a linear framework model of any convex polyhedron that does not consist of triangular faces is constructed and the faces are symmetrically triangulated, even though the overall structure is stable, it suffers from a local instability. This instability occurs within the now triangulated, but still planar faces.

If a load is placed on any joint that is within, and co-planar to a given polygonal face, it will be found to have only limited stability. It is not complete rigid, as the loaded joint will tend to move slightly in or out, in a direction normal to the face plane of the polygon with which it is associated.

There are two fundamental ways to improve this condition, both of which stem from the same physical phenomenon. Only one of the methods will allow the polygon to remain planar. This can be accomplished by creating a rigid, double layer space frame structure that corresponds to the plane polygonal faces. The second, and simpler, alternative is to position the joints of the triangulated subdivisions such that a convex or concave (dome-like) arrangement is created on each face. This latter system requires less material but can no longer provide planar faces.

In order to triangulate the basic polyhedra volumetric modules of the present system, it is useful to investigate those faces which can be subdivided into equilateral triangles. In the polyhedra and basic space units there are only four cases: a regular hexagon of unit ($x$) edge length; a hexagon with three one-unit ($x$) edges and three two-unit ($2x$) edges; and a triangle of two-unit ($2x$) edge.

When these faces are triangulated, only the hexagons have vertices within their periphery. The trapezoid, which is actually a one-half hexagon, consists of only three triangles and, like the two-unit edged triangle composed of four one-unit edged triangles, does not create the structural problem of local instability described above.

Therefore, it is only necessary to find a method of stabilizing the two different kinds of hexagons. It is, incidentally, these two hexagons that combine to form the parallel planar layers which become the floors of the multilevel structures which are based on the space filling array of truncated octahedra, and the space filling array of cuboctahedra/truncated tetrahedra/truncated octahedra.

Both planar and domical solutions to the stabilization of the hexagons have been developed based upon the basic inventory of components shown in FIG. 2 in the arrangement of a regular tetrahedron 26. The altitude of all of the basic space units is identical to this regular tetrahedron. When three (B) components 16 are attached to the triangular base 28 composed of (A) components 14 a low pyramid 30 is formed. The apex of this pyramid 30 falls at the exact center or centroid of the original regular tetrahedron 26 formed by the (A) components 14. The altitude of this pyramid 30 is exactly ¼ that of the regular tetrahedron.

A space frame system has been developed based upon this triangular pyramid 30, which incidentally, may also be considered a tetrahedron, although it is not regular by virtue of the fact that it has only one equilateral triangular face, the other three being isosceles. This irregular tetrahedron or pyramid 30 is, in fact, ¼ the volume of the full regular tetrahedron 26.

Figure 9A:
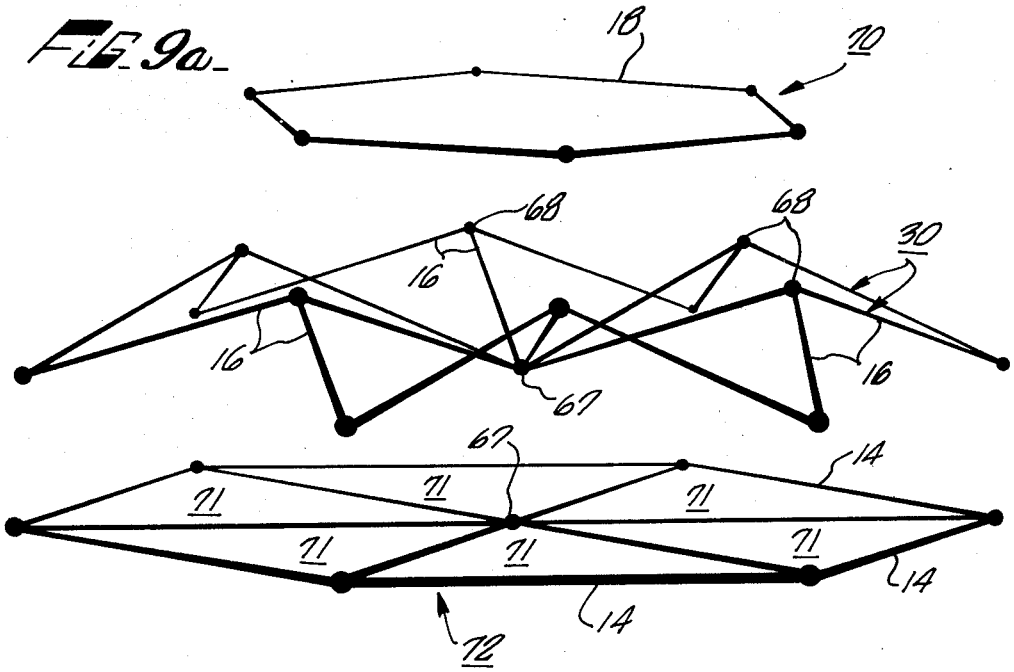
Figure 9B:
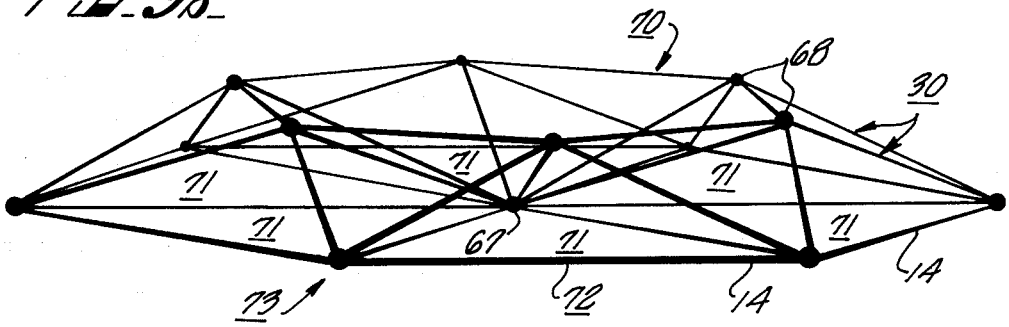
Figure 9C:
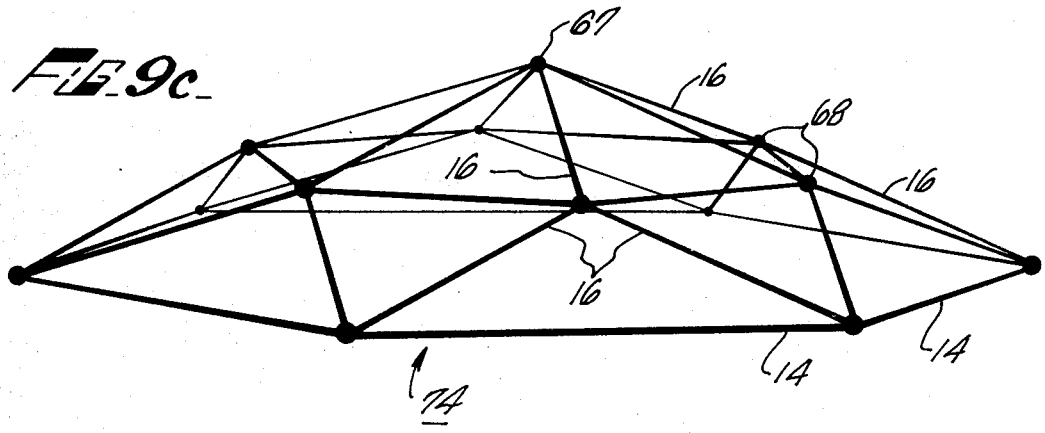

Turning to FIGS. 9*a*, 9*b* and 9*c*, an exploded view is shown in FIG. 9*a* of a framing system. Six of these quarter tetrahedra or pyramids 30 can be arranged on a common plane around a single point 67. When this is done, the apices 68 of these pyramids 30 are joined in a hexagonal ring 70 composed of (C) components 18. The six equilateral base triangles 71, composed of (A) components 14 combined to form a regular hexagon 72. This complex thus serves as a planar stabilization of the regular hexagons of the basic space units as shown in FIG. 9*b*.

This system may be extended infinitely in a common plane. When this is done a complex of quarter tetrahedra pyramids 30 and hexagonal pyramids is formed. This system will be referred to as the tetrahex truss 73. It is normally used in an inverted position with the apices of the quarter tetrahedra pyramids 30 pointing downward rather than upward as they are in FIG. 9.

A careful study shows that inherent to the tetrahex system is the possibility of transforming the planar truss 73 to a domical system. In the case of the regular hexagon of our space units in which the tetrahex truss 73 is formed by a set of six quarter tetrahedra as in FIG. 9*b*, a simple hexagonal dome unit 74 may be formed by a simple redirection of six of the (B) components 16. This amounts to the inversion of the central hexagonal pyramid having an apex at the point 67 and makes possible the omission of the six of the 12 (A) components 14 of the original planar configuration which met at the point 67. This again demonstrates the superior efficiency of domical system over planar systems.

Figure 10A:
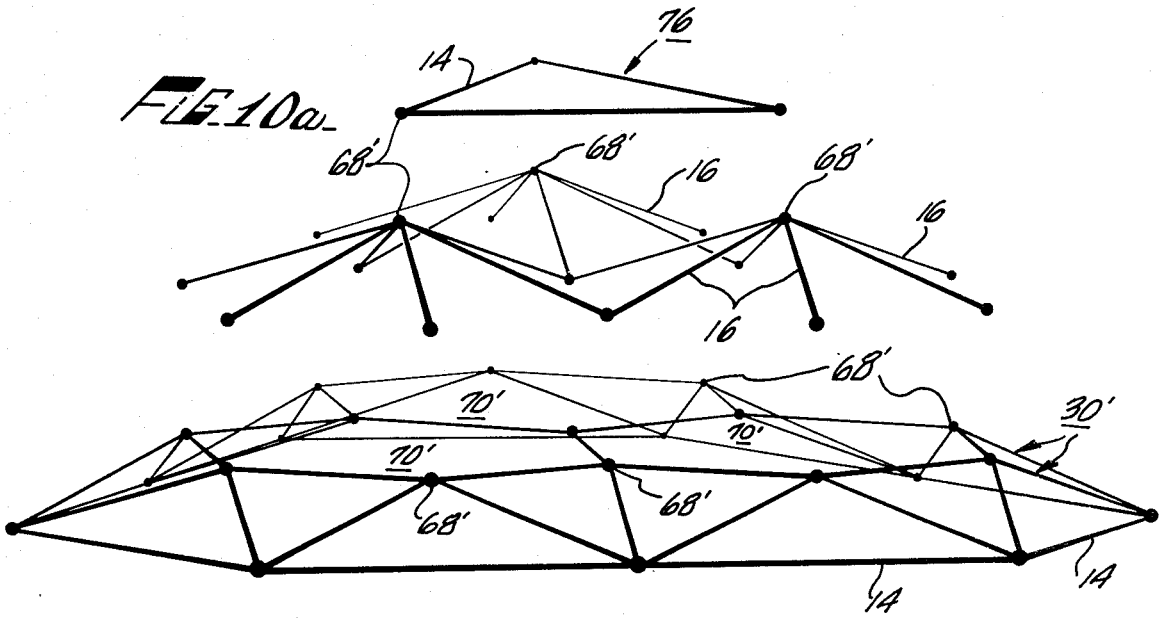
FIGS. 10A, 10B and 10C, is a perspective view of the triangulation for rigidity of the hexagonal base of the equitorial portion of a truncated octahedron.

In FIG. 10, there is shown a similar treatment of the hexagon of the space units, which is bounded by three edges of one-unit ($x$) length and three edges of two-unit ($2x$) length. This hexagon, too, can be accommodated with this tetrahex system. In this case, 13 quarter tetrahedra 30′ are combined and their apices 68′ joined with (C) components into three interconnected hexagons 70′.

Figure 10B:
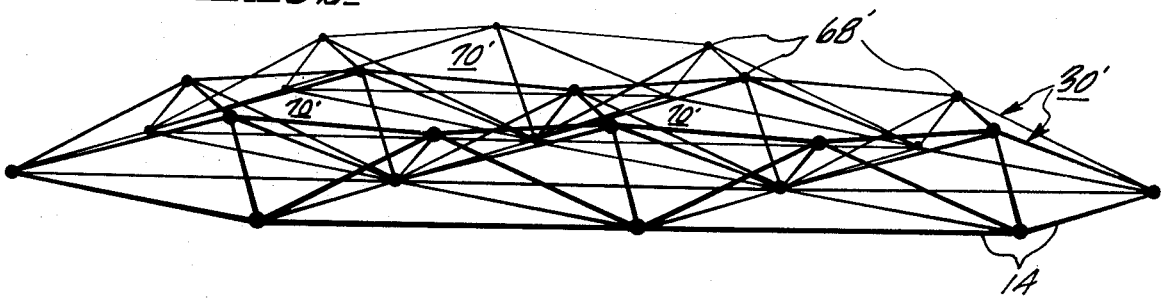
Figure 10C:
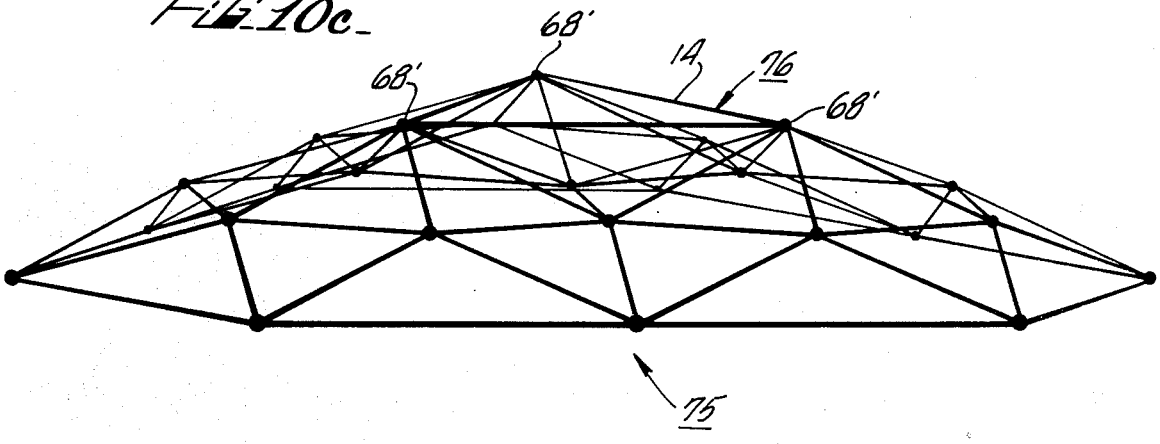

In the case of the second hexagon of ($x$) and ($2x$) sides, of FIG. 10, the same transformation from truss to dome can occur. However, this time there are three hexagonal pyramids which are inverted in the process of redirecting 18 (B) components 16. This arrangement, which eliminates 12 (A) components 14, forms a compound, triple-hex dome system 75 with three apices 68′. For total stability these three peaks must be joined by an equilateral triangle 76 of (A) components 14. FIG. 10*b* shows the planar truss and FIG. 10*c* shows the compound dome 75.

In the discussion so far, only three of the six basic components have been used. As has been noted, the (A), (B) and (C) components 14, 16, 18 constitute the primary set. Before going on to show the diversity of application of tetrahex planar and dome systems to the polyhedral space unit packings, it will be useful to describe an additional planar system which can be assembled with the (A), (B) and (C) components. There are alternative ways that the basic tetrahex truss 73 of FIG. 9*b* can be developed into efficient clear span systems.

As a large clear span system, the planar tetrahex truss 73 could probably function effectively on the basis of a 25 to 1 span to depth ratio, although this is misleading because by supporting such systems according to hexagonal plans with supporting members on three sides, this ratio is effectively increased. In order to considerably increase this span to depth ratio with a planar space structure it is possible to create a "double layer" tetrahex truss 77, in such manner that two tetrahex trusses 73 share the same equilateral triangular planar grid. The two tetrahex trusses 73 are inverted with respect to each other and the triangular grid floats between them.

All of the alternative systems just discussed require only the (A), (B) and (C) components 14, 16, 18, of FIG. 2. Because of this, it is conceivable that it would be a simple matter in any given architectural structure to make transitions from one system to another whenever requirements suggested such changes.

In the area of planar space frame systems, the addition of the (D) and (E) components 20, 22 to the primary set of three (A), (B) and (C) components 14, 16, 18, makes possible the formation of a set of novel structures which have close interrelationships to each other and to our primary tetrahex truss 73. As discussed above, a double tetrahex truss 77 is made by placing two basic tetrahex trusses 73 back to back, such that they share a common horizontal grid of equilateral triangles composed of (A) components 14.

Figure 11:
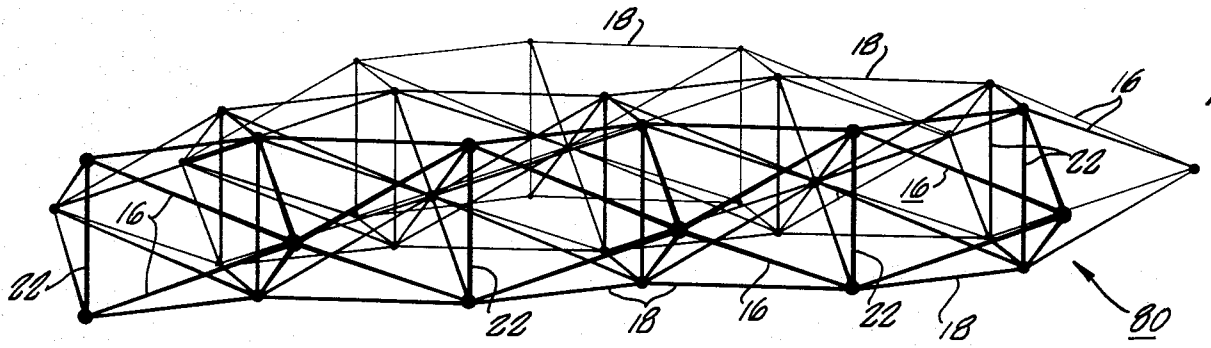
FIG. 11 is a perspective view of an alternative truss structure employing additional frame components combined in an octahex truss.

A variation of this structure can be achieved by removing the horizontal grid of equilateral triangles composed of (A) components 14, and installing (E) components 22 such that vertically opposite apices of the back to back quarter tetrahedra are connected, best seen in FIG. 11.

This change has the effect of maintaining a fully stable triangulated truss, while at the same time creating a system in which all components are more nearly equal in length than is the case of the double tetrahex truss 77. Components (B) 16 and (C) 18 differ in length by a mere 5.7%. The average length of (B) 16 and (C) 18 differs from the (A) component 14 by 40.6 % while differing from the (E) component 22 by 31.1%.

The geometry of this truss is interesting to note. What is inadvertently formed is a collection of orthorhombic octahedra clustered in hexagonal sets, and is called an octahex truss 80.

Figure 12:
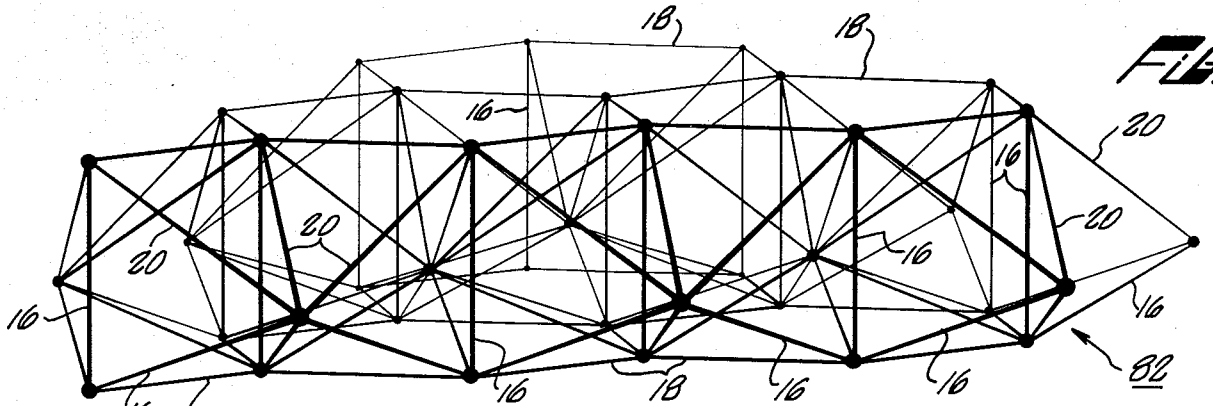
FIG. 12 is a perspective view of another alternative truss structure formed with monoclinic octahedra.
Figure 13:
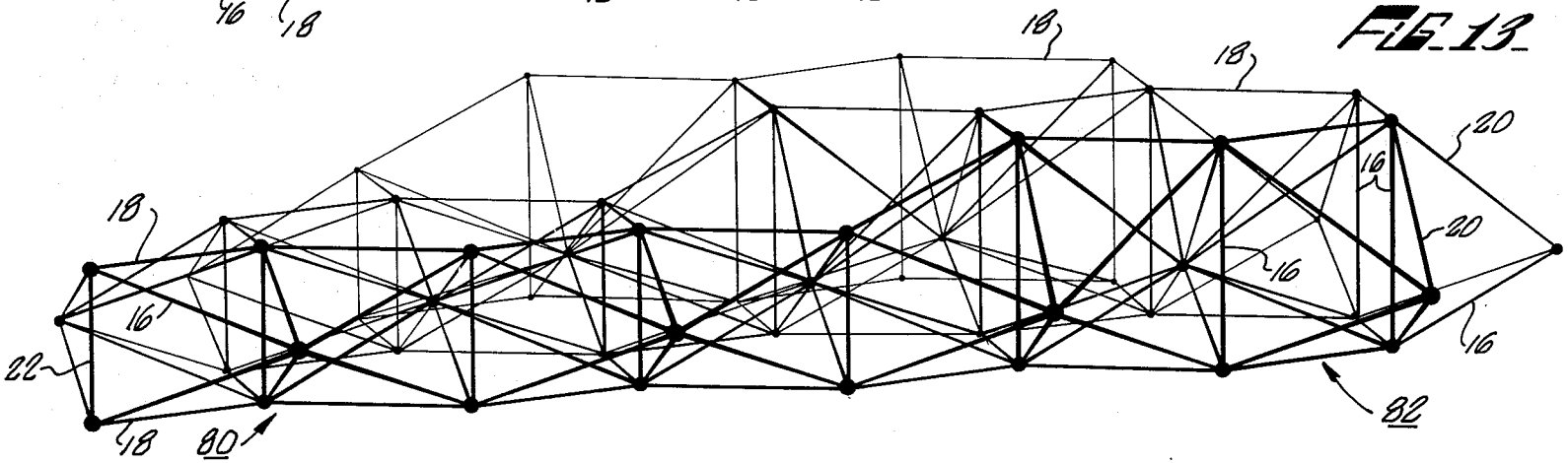
FIG. 13 is a perspective view of a combined truss structure, including the structures of FIGS. 11 and 12.

An interesting variation of the octahex truss 80 is shown in FIG. 12. By substituting (B) components 16 for (E) components 22 and some (D) components 20 for certain (B) components 16, another octahex truss 82 is formed with monoclinic octahedra. This results in a truss of greater depth per modular increment than the orthorhombic octahex 80 truss of FIG. 11. Perhaps what is most significant about this system is that it is possible to change "organically" from the orthorhombic to monoclinic octahex truss without violating the modularity of the system. This makes possible the simple formation of variable depth trusses as illustrated in FIG. 13.

Within the parameters of a fixed horizontal modular grid it is possible to effect "organic" transitions from the simple tetrahex truss 73 to the orthorhombic octahex truss 80, to the monoclinic octahex truss 83, and beyond. With such a system it is possible within the fixed modular grid to vary truss depth by a factor of 4 or more. The variation in depth between the two types of octahex truss is exactly 33.3%. Such variable depth trusses make possible efficient formation of great clear span distances, while maintaining the rigorous periodicity of a modular system.

From the examples of these planar trusses, the implications of the minimum inventory/maximum diversity concept as a principle become apparent. Being limited to one branch length, say the (A) component 14, there is only one possible fully triangulated space frame, namely, that which is composed of regular tetrahedra and regular octahedra. In order to get additional workable options, two additional components: the (B) and (C) components 16, 18, must be added. This provides a number of new options both planar trusses (the tetrahex and double tetrahex trusses) and a great variety of domical and partial dome-like structures. If then the (D) and (E) components 20, 22 are added to the inventory, even more options are available, as has been shown.

Although it is quite feasible to envision a system which consists of only one component, it will of necessity have very limited ability to accommodate the requirement for diversity. On the other hand, it does not follow that an infinite number of components will yield any more diversity than a well chosen minimum set. A plot of Inventory (i.e. number of components) against Diversity (i.e. number of combinations and permutation or options) would lead to the observation that, although each new component that is added tends to increase the number of options geometrically at the outset, as the components are added, this geometrical progression slows and after a certain point the addition of new components only increases the options very slightly.

There is an optimum zone which yields the most efficient balance between fewest numbers of components and greatest numbers of options. One can suspect that there is a very fundamental combinatorial principle operative within this concept probably comparable to an idealized learning curve.

The present system which employs the elements of FIG. 2 would appear to be a minimum set of very high efficiency. Based on past experience, as far as basic frameworks are concerned, the inventory is not likely to be greater than 7 or 8 primary and secondary branch components. However, in the preferred embodiment, the basic set of 6 components seems nearly optimum.

It is typical of environmental structures formed with the system of the present invention that no truly vertical branch components occur. This is true even in multistory structures. Because of the three dimensional triangulation, the members which separate horizontal floors are inclined off vertical. In spite of this, it is still possible to partition space into rooms with perfectly vertical walls.

This penomenon is perhaps most easily explained by the relationship of a hexagonal prism 86 with its vertical walls to an octahedron 54 with its inclined walls. In FIG. 14, which includes FIGS. **14*a* and 14*b*, can be seen two views in which the hex prism 86 and the octahedron 54 are superimposed. The linear octahedron 54 forms a triangulated structural frame and the surface hexagonal prism 86** defines the shape and volume of the space enclosed. In such an arrangement the structural function is differentiated from the space enclosing system. This has implications for the notion of adaptable environments, since changeable partitioning can be envisaged, independent of structure.

Figure 15B:
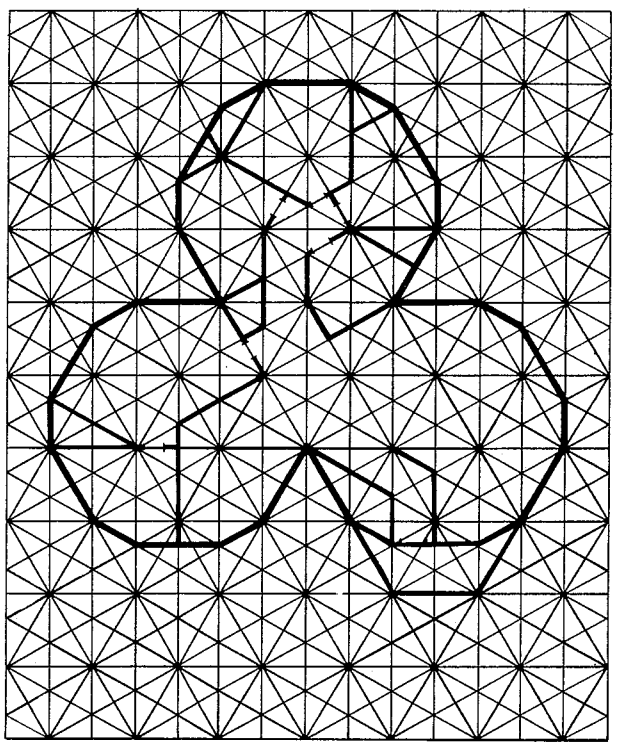
FIGS. 15A and 15B, is a design grid for structures according to the present invention with floor plans indicated thereon.
Figure 15A:
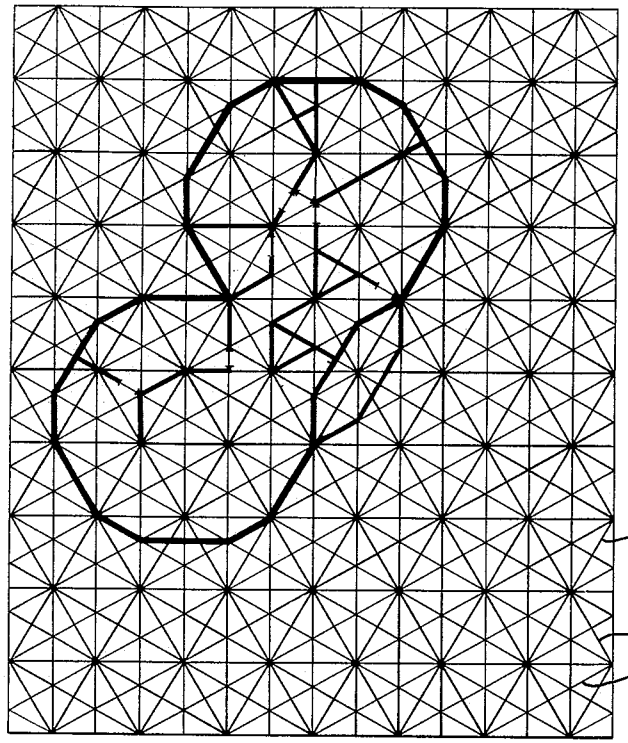

A modular partitioning system has been developed that is organically coordinated with the "kit of parts" shown in FIG. 2. The basic geometry of this modular partitioning system is derived from a primary equilateral triangular grid 88 defined by component (A) 14 and a secondary grid, defined by components (C) 18, which is superimposed forming a compound, multidirectional, rectangular subgrid over the original triangular grid 88. This grid can be seen in FIG. 15. By combining rectangular with triangular grids, a vast array of spatial options can be provided. The benefits of triangular and rectangular geometry can both be taken advantage of and conventionally shaped rectangular rooms can be formed along with triangular, trapezoid, rhombic, hexagonal and even 12 sided rooms. The floor plans for a "bi-cluster" and a "tri-cluster" housing unit are shown in FIGS. **15*a* and 15*b*,** respectively, superimposed on the original partition grid. It becomes clear from these examples that a great variety of housing and interior plan arrangements are possible and that varieties of family needs can be readily accommodated.

Figure 16B:
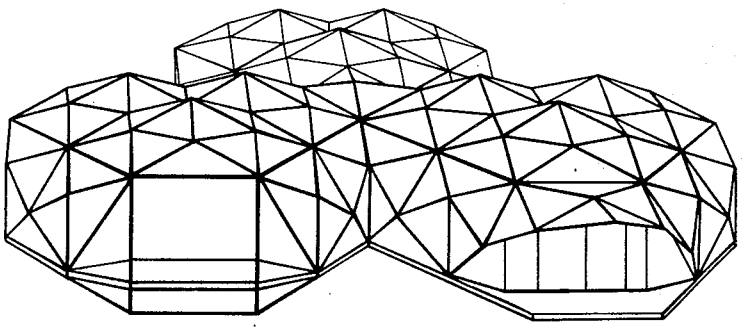
FIGS. 16A and 16B, is a perspective view of structures according to the present invention employing the floor plans of FIGS. 15A and 15B, respectively.
Figure 16A:
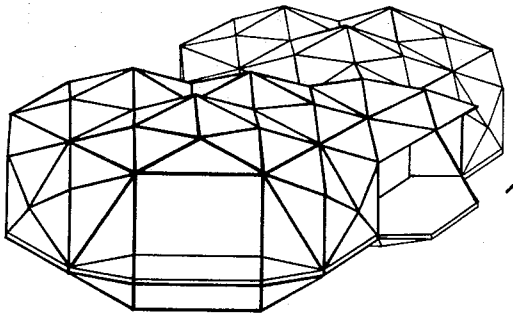
Figure 11:
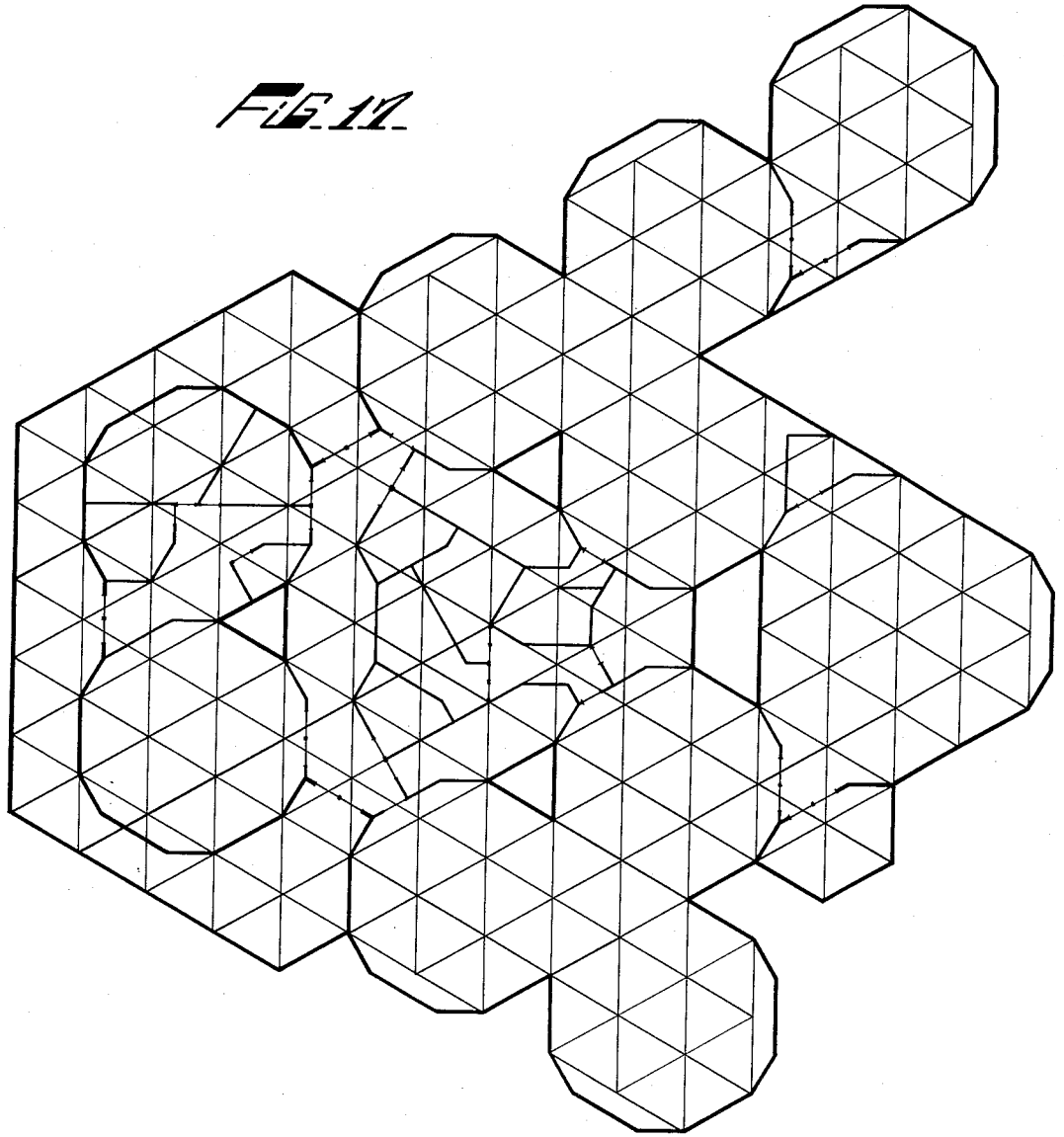

A perspective view of such a structure is shown in FIG. 16, with the bi-cluster shown in FIG. **16*a* and the tri-cluster in FIG. 16*b*.** The geometry of this dwelling structure is composed of truncated octahedron space units.

The application of the (A), (B) and (C) components 14, 16, 18 to the space units is of both structural and geometric interest.

In FIG. 17, there is shown a floor plan of the structure of FIG. 1 superimposed on the triangular grid 88 of FIG. 15. Shown are the various clear span areas which can be utilized for various functions and other areas are partitioned into smaller spaces. In order to build structures such as shown in FIG. 1 or FIG. 16, an additional development must be undertaken, starting with the set of basic struts shown in FIG. 2 and employing the domes and trusses described above.

As has been noted, the truncated octahedron 60 is the simplest and most economical in terms of surface area to volume ratios of the space filling systems that have been discussed. FIGS. 18 through 20 show applications of the (A), (B) and (C) components 14, 16, 18 of the present system to the truncated octahedron 58 and its respective space units.

Figure 18A:
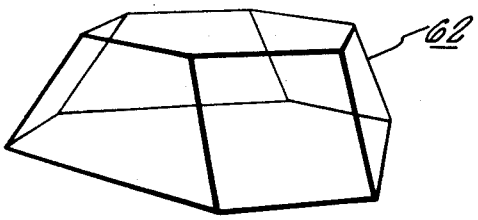
FIGS. 18A, 18B and 18C, illustrates in perspective view the triangulation of a polar space unit from the truncated octahedron.
Figure 18B:
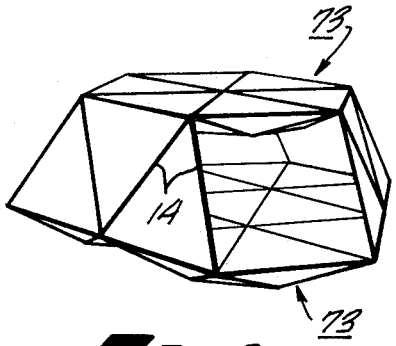
Figure 18C:
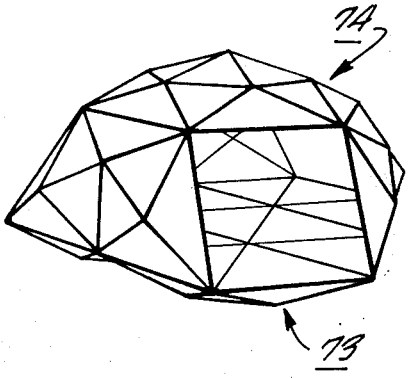

FIG. 18*a* shows the polar space unit 62 from the truncated octahedron 60. FIG. 18*b* shows a planar triangulation of the same space unit and FIG. 18*c* shows a domical triangulation of the space unit. In the planar system, two tetrahex truss assemblies 73 are separated by 12 (A) components 14, which form three sets of three triangles each; i.e. nine triangles, which in turn form three ½ hexagons. These triangulated ½ hexagons, which are parallel to the faces of a tetrahedron, interact with the planar trusses in such a way that it is unnecessary to triangulate the square faces. In FIG. 18*c* can be seen the same polar space unit 62 with the hex dome 74 on the upper surface, half hex domes on the sides, and a lower planar truss 73. The square faces are again stable. This domical structure still requires only components (A), (B) and (C).

Figure 19A:
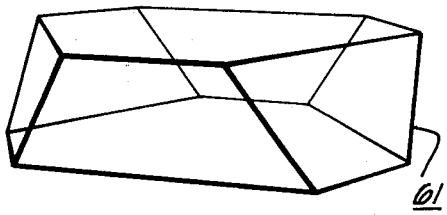
FIGS. 19A, 19B and 19C, illustrates the triangulation of the equatorial space unit of the truncated octahedron.
Figure 19B:
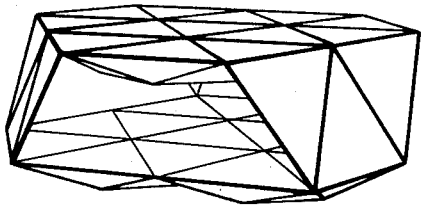
Figure 19C:
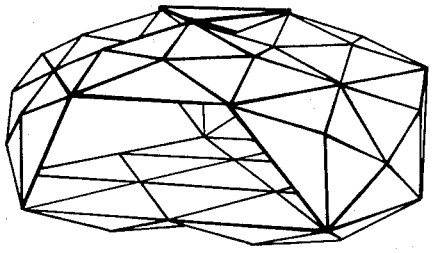

The second space unit derived from the truncated octahedron 60 is shown in FIG. 19*a*. It is the equatorial unit 61 composed of six half hexagons around its periphery which separate two equal hexagons with sides equal to ($x$) and ($2x$). In FIG. 19*b*, there is shown a planar triangulated version of this space unit. It is only necessary to triangulate three of the half hexagons for the structure to be stable. The three nontriangulated, open half hexagons are stable for the same reasons as are the square faces of the previously discussed figure. The three triangulated half hexagons are parallel to the faces of the regular tetrahedron and interact with the planar trusses stabilizing the open faces. FIG. 19*c* shows the domed version of this truncated octahedral space unit, still using only components (A), (B) and (C), 14, 16, 18 of FIG. 2.

The full truncated octahedron 60 is shown in FIG. 20*a*. The planar triangulated version is shown in FIG. 20*b* and the domical version is shown in FIG. 20*c*. In order for the planar version to be fully stable, it is necessary to include altogether four planar tetrahex trusses 73 separated by (A) components 14 on the hexagonal faces. As we have seen in the other cases, the square faces need not be triangulated.

The full domed truncated octahedron becomes an approximate full sphere. In this structure, it is necessary to triangulate five of the six square faces for complete stability. The triangulation of the square faces introduces a new edge length not previously defined. The square face could be "X" braced with (D) components 20. However, this results in a planar triangulation which suffers from local instability as discussed above. The new joint formed by the "X" bracing is in the plane of the square face.

In order to eliminate this local instability, it is necessary to move the joint at the center of the square, off the plane of the square face. That is, it is necessary to triangulate the square faces with pyramids. None of the original components of FIG. 2 are of such lengths that this can be accomplished. Therefore, it is necessary to add a new component. Because this component is not a critical one to the modularity of the system, it can be of arbitrary length so long as a pyramid is formed on each face of the parent, truncated octahedron.

It should be noted that in this "spherical" triangulated truncated octahedron, stability is achieved without the planar tetrahex trusses except for a single truss at the bottom of the structure. Because of this, the spherical configuration requires less material than the planar version, revealing, again, the structural efficiency of the nonplanar system.

Even though any arbitrary length of component can be used to form the square pyramid mentioned above, if the sphere-like domical triangulation of the truncated octahedron is examined, it will be noted that there is a length ratio which has a unique consistency with the system as a whole. The triangulated polyhedron in FIG. 20*c* is assembled from two kinds of triangles in addition to the triangles which form the pyramids over the square faces, namely, triangles No. 1, 34 and No. 2, 36 from FIG. 3. There are 48 pairs of No. 2 triangles 34 which meet at 180° on a common (C) 18 edge, and there are 12 pairs of No. 1 triangles 34 which meet at 180° on a common (A) edge 14. Since both these sets of paired triangles meet at 180°, a collection of two kinds of rhombic faces is formed. As noted above, exterior faces may be created by employing the panels of FIG. 3 whose edges identically correspond to the struts of FIG. 2. It is therefore possible to create structures in which abutting edges of adjacent panels replace the corresponding strut without affecting the integrity of the structure.

This approach has been employed in the structure illustrated in FIG. 20*c*.

Twenty-four additional No. 1 triangles 34 are found positioned around the square faces of the truncated octahedron 60. A unique edge length may be chosen such that the 24 faces of the six square pyramids, which are required to fully triangulate the truncated octahedron, meet the corresponding No. 1 triangles 34 on common (A) edges at 180°. If this is done, the No. 1 triangles and the isosceles triangles from the square pyramids, taken as units, form a set of 24 plane trapezia. Therefore, a convex polyhedron may be formed which includes these 24 trapezia, the 48 sets of rhombic faces which combine the pairs of No. 2 triangles 38, and the 12 sets of rhombic faces which combine the pairs of No. 2 triangles 38, and the 12 sets of rhombic faces which combine the pairs of no. 1 triangles. Such a polyhedron has 84 faces total and is shown in FIG. 20*d*.

The advantage of such a polyhedron is that it may be triangulated in a variety of ways without altering its shape. That is, each kind of plane quadrilateral face may be triangulated on a long or short diagonal without altering the 180° relationship between paired triangles. For example, the rhombic face which is assembled from a pair of No. 1 triangles may be triangulated by either the (A) or (D) components from FIG. 17. The option of triangulating the rhombic face with either a short or long diagonal is then available. With the basic kit of parts shown in FIG. 2, however, components for the long diagonal triangulation of the rhombus formed by the pair of No. 2 triangles, or for the alternate triangulation of the trapezium face are not provided in the basic invention. It is clear therefore that an infinite variety of triangulations can be achieved. Further, it is also clear that for every triangulated skeletal structure, there exists a counterpart structure which is the envelope of the skeletal structure in which appropriate exterior panels are either used in conjunction with or in replacement of the struts which comprise the exterior "edges" of the structure.

In FIG. 21, there can be seen the three faces of the 84-faced polyhedron. The relevant face angles and edge length ratios, including long and short diagonals of elements not previously described are set out in Table III, below.

TABLE III

| Panel | Sides | Angles |
|---|---|---|
| — | B·G·B | 28°8′, 123°44′, 28°8′ |
| 10 | H A H | 46°41′, 86°38′, 46°41′ |
| 11 | B I H | 54°44′, 81°57′, 43°19′ |

From this information, a (G), (H), and (I) component 92, 94, 96 may be added to the inventory of linear relationships shown in FIG. 2 and are defined in Table IV, below.

TABLE IV $$G = A \frac{\sqrt{42}}{6} = 1.0802A$$

$$H = A \frac{\sqrt{34}}{8} = .7289A$$

$$I = A \cdot \frac{5\sqrt{2}}{8} = .8839A$$

It is important to point out that these new components, particularly (H) and (I) 94, 96, only have meaning for the terminal regions of structures assembled from the system of the present invention. As a practical matter the (G) component will have little general utilization, but is included to give a complete and consistent description of the system.

One advantage of alternative ways to triangulate the 84 quadrilaterals of the polyhedron of FIG. 20*d* is that it may be fractionated along a number of alternative planes so that domes of a surprising number of different heights and orientations can be assembled. For example, compare FIGS. 20*c*, 20*e*, 20*f*. In FIG. 20*c*, the polyhedron is triangulated with long diagonals on the trapezium faces and the No. 1 rhombic face. and short diagonals of the No. 2 rhombic face.

In FIG. 20*e*, all faces are triangulated with their respective short diagonals. In FIG. 20*f*, the trapezium faces have short diagonals. One can imagine from these examples all of the symmetrical and asymmetrical permutations for the triangulation of the polyhedron.

Figure 21A:
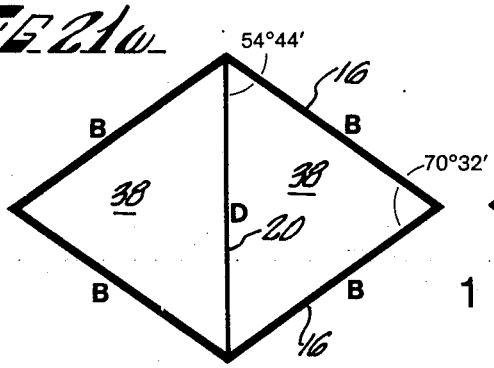
FIG. 21 illustrates the faces of the 84-faced polyhedron of FIG. 20D.
Figure 21B:
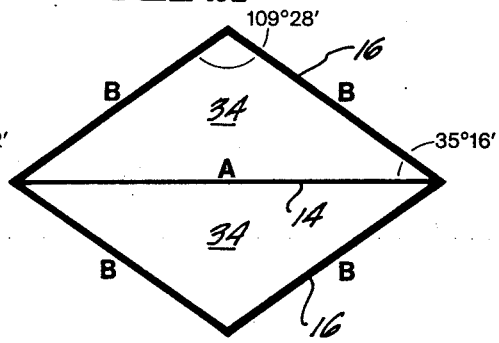
Figure 21C:
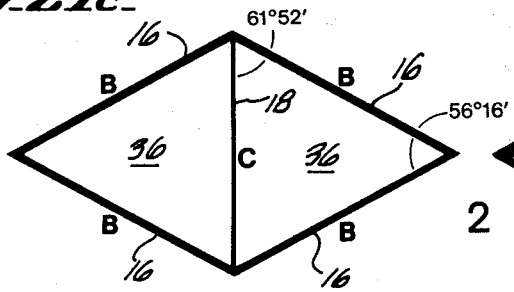
Figure 21D:
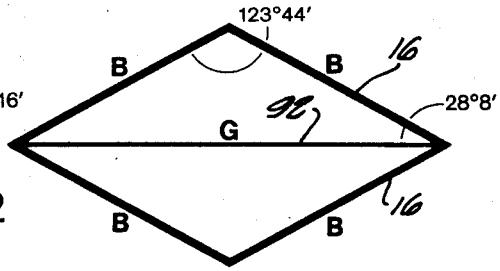
Figure 21E:
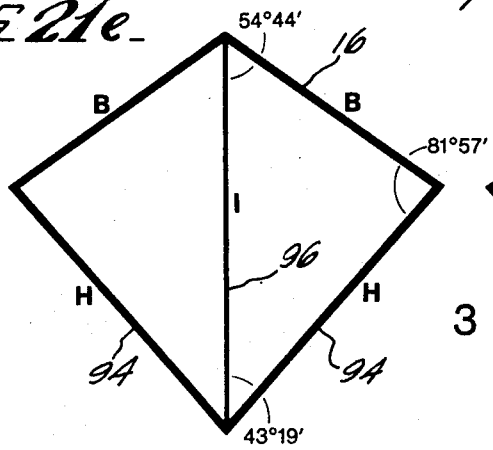
Figure 21F:
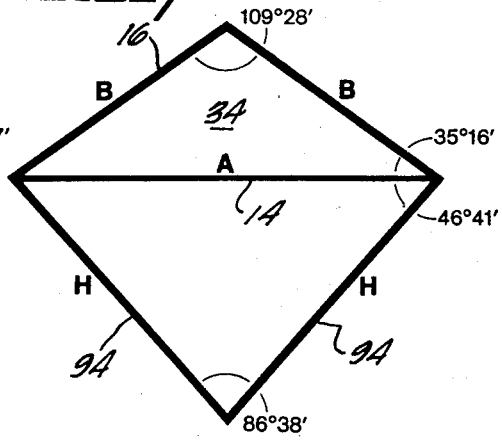

As illustrated in FIG. 21, the (D) component 20 is an alternative means of stabilizing a rhombus formed by four (B) components 16 (FIG. 21*a*) which can also be stabilized by (A) components 14 (FIG. 21*b*). Where it is appropriate, it is probably better to stabilize such a rhombus with the (D) component 20 as in FIG. 21*a* rather than the (A) component 14 as in FIG. 21*b*, simply because it is nearly 40% shorter and, therefore, uses substantially less material.

Figure 22:
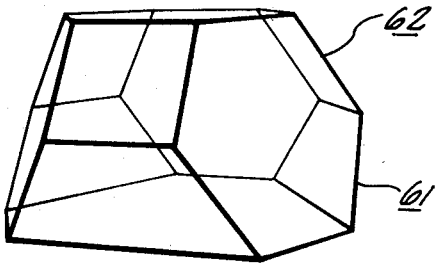
FIG. 22, including
Figure 22B:
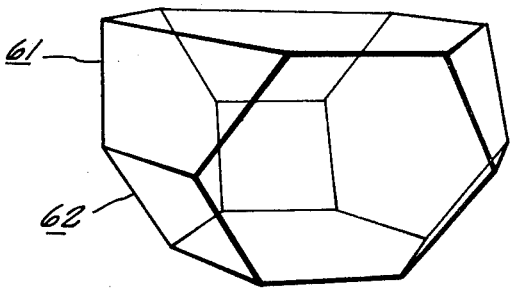
Figure 22C:
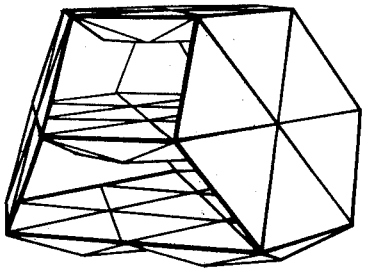
Figure 22D:
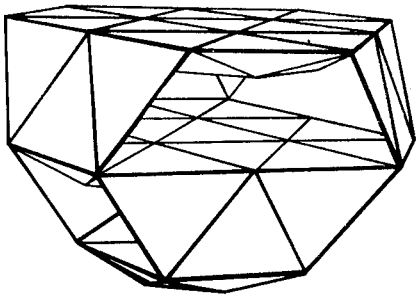
Figure 22E:
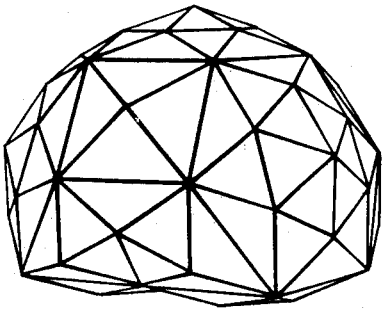
Figure 22F:
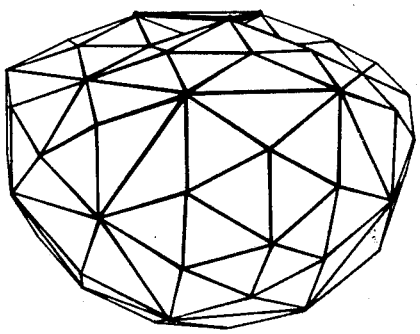
Figure 23A:
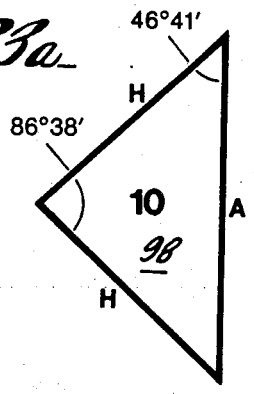
FIGS. 23*a* – 23*d* illustrate terminal panels which are useful in the present invention.
Figure 23B:
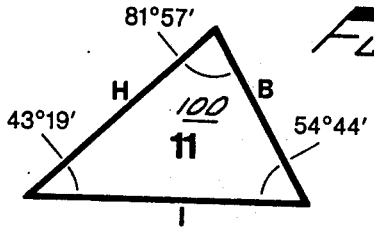
Figure 23C:
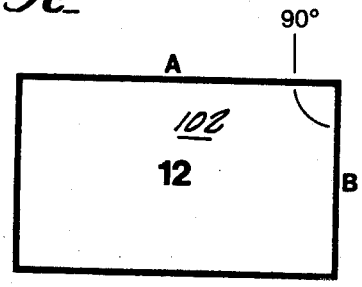
Figure 23D:
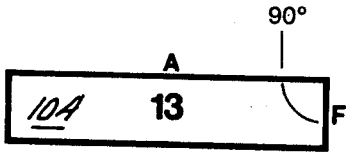

In addition to the spatial systems based upon the "equatorial" and "polar" space units 61, 62 of the truncated octahedron 60 and the full truncated octahedron, it is also useful to consider two alternative spatial systems assembled from an equatorial plus polar space unit, 61, 62, i.e. a ⅔ truncated octahedron. One version has the polar space unit 62 above the equatorial space unit 61 and the other reverses that condition. FIGS. 22*a* and 22*d* show these two systems. The planar and domical triangulated versions are shown in FIGS. 22*b* and 22*e*, and 22*c* and 22*f*, respectively.

In FIG. 3, above, nine interstitial panels were illustrated. All of these panels relate to the periodicity of the system. To this inventory it is useful to add four "terminal" panels. These are shown in FIG. 23. Panels No. 10 and No. 11, 98, 100 are derived from the trapezia of FIG. 21*e*, 21*f*. The rectangular panels No. 12, 102 and No. 13, 104 are included here to complete the basic inventory of useful interstitial panels.

Like the exterior surface modules or interstitial panels of FIG. 3, a set of interior partition modules are also defined in terms of the set of six basic components of FIG. 2. The dimensions of the partition panels are all multiples or submultiples of the linear relationships of these six components.

Figure 24:
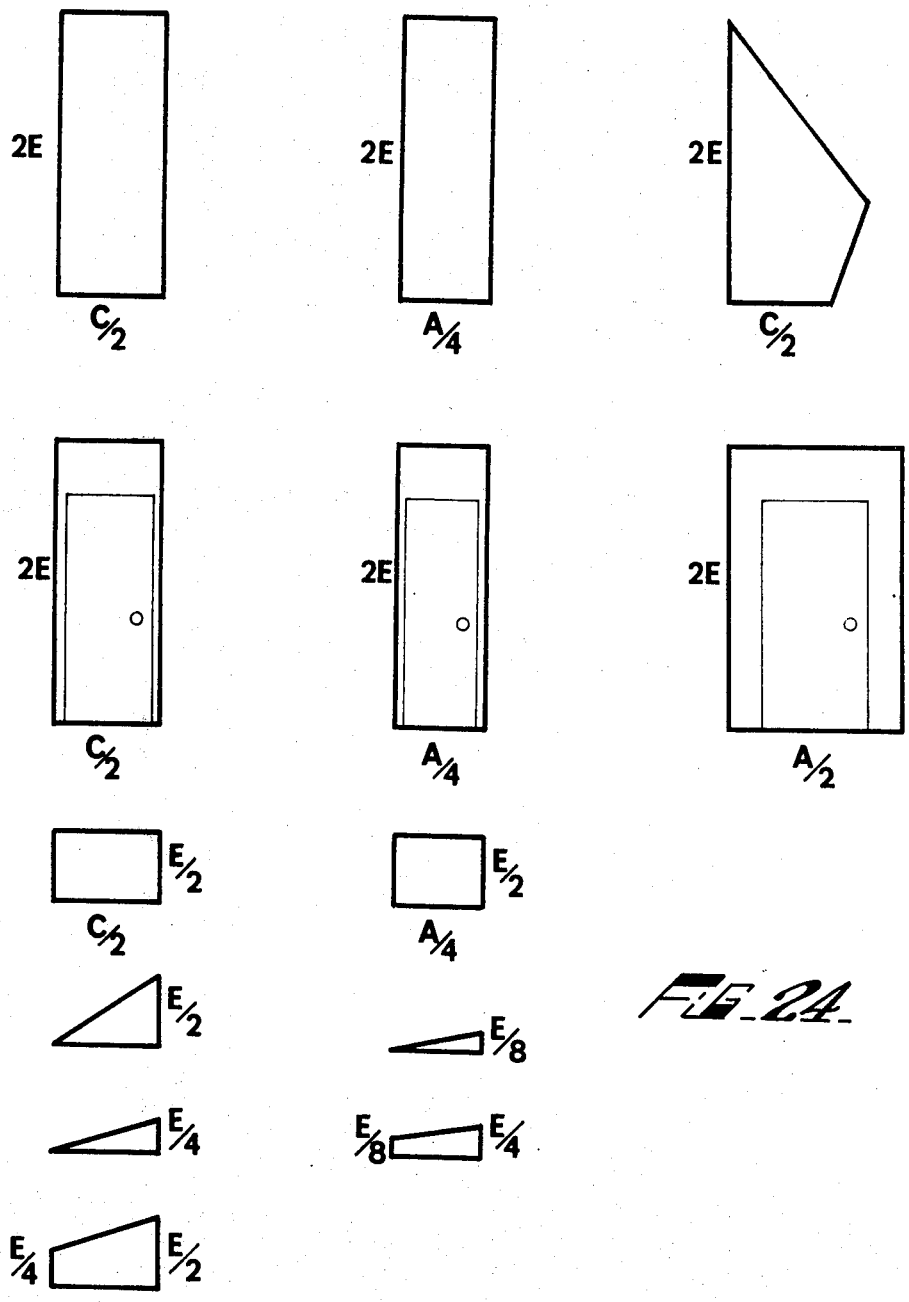
FIG. 24 illustrates a plurality of interior partitioning modules useful in the system of the present invention.

FIG. 24 shows a basic set of interior partition modules. There are two modular increments in the system corresponding to submultiples of (A) components 14 and (C) components 18. The small rectangular, triangular and trapezoidal modules serve as transition elements which accomodate the convolutions of the ceiling structure.

Figure 25A:
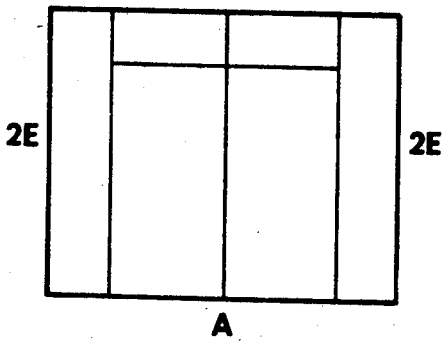
FIGS. 25*a* – 25*b* illustrate entrance modules useful in the system of the present invention.
Figure 25B:
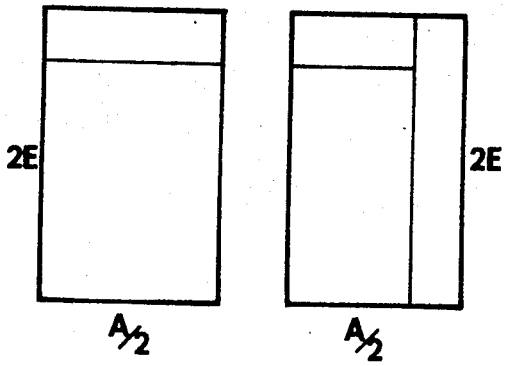

In FIG. 25, the entrance modules are illustrated, which account for the exterior door options. These entrance modules permit alternative doors such as a double door, a door of A/2 width and a panel which is one half of the double door module.

Figure 26:
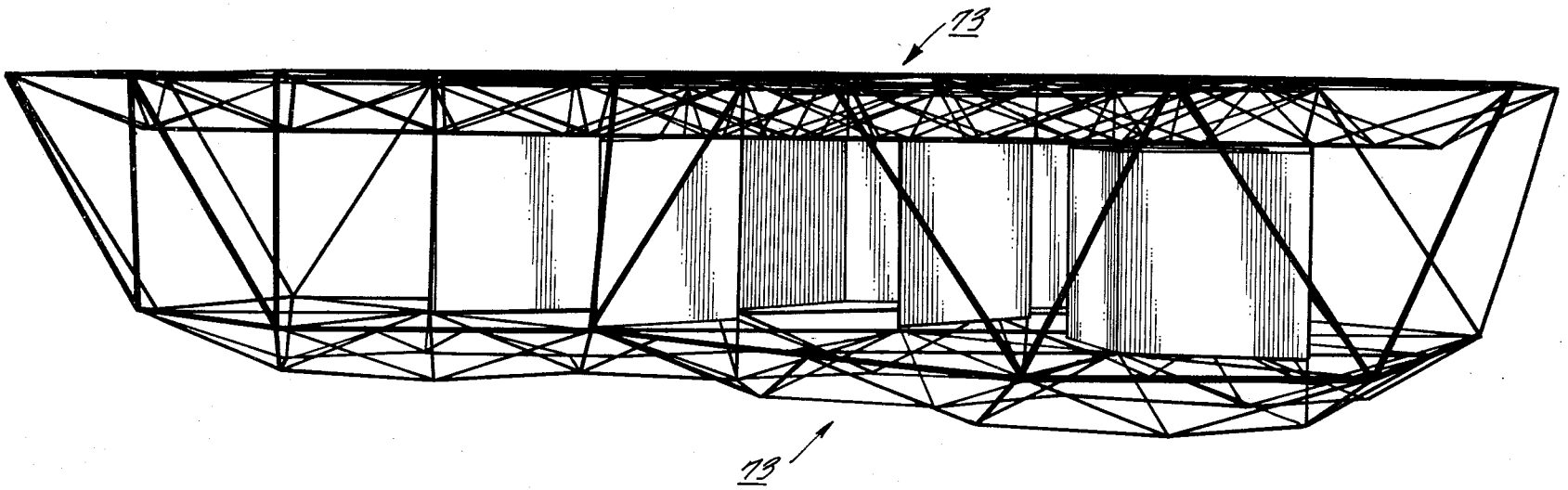
FIG. 26 is a pespective view of a section from a structure illustrating the provision of a "floor" and "ceiling"

The number of room options made possible with the present system is unlimited both in size and shape. FIG. 26 shows a section from a structure illustrating the coordination of "floor" and "ceiling" by the partitions. As shown, the floor and ceiling are truss structures 73 defining an open area between them.

In FIG. 19, a structural enclosing system was based upon the equatorial space unit 61 from the truncated octahedron 60. This configuration constitutes a basic domical unit of great simplicity and usefulness. When the (A) components 14 have a length of 10 feet, this basic unit has a floor area of 692 square feet. When two such domical units are joined, a floor area of 1,328 square feet is provided, and a tri-cluster of such domical units forms a shelter of 2,119 square feet. Floor plans for such structures were shown in FIGS. 15*a* and 15*b* and were shown in perspective in FIGS. 16*a* and 16*b*. The 10 foot module provides an excellent scale for the present system when it is used for single story structures.

It should be noted that the foundation-floor is an integral part of the total structure and requires no reference to a "solid" ground for structural completeness. This, like most of the building configurations of this system, can be described as a structrually autonomous system.

Figure 27:
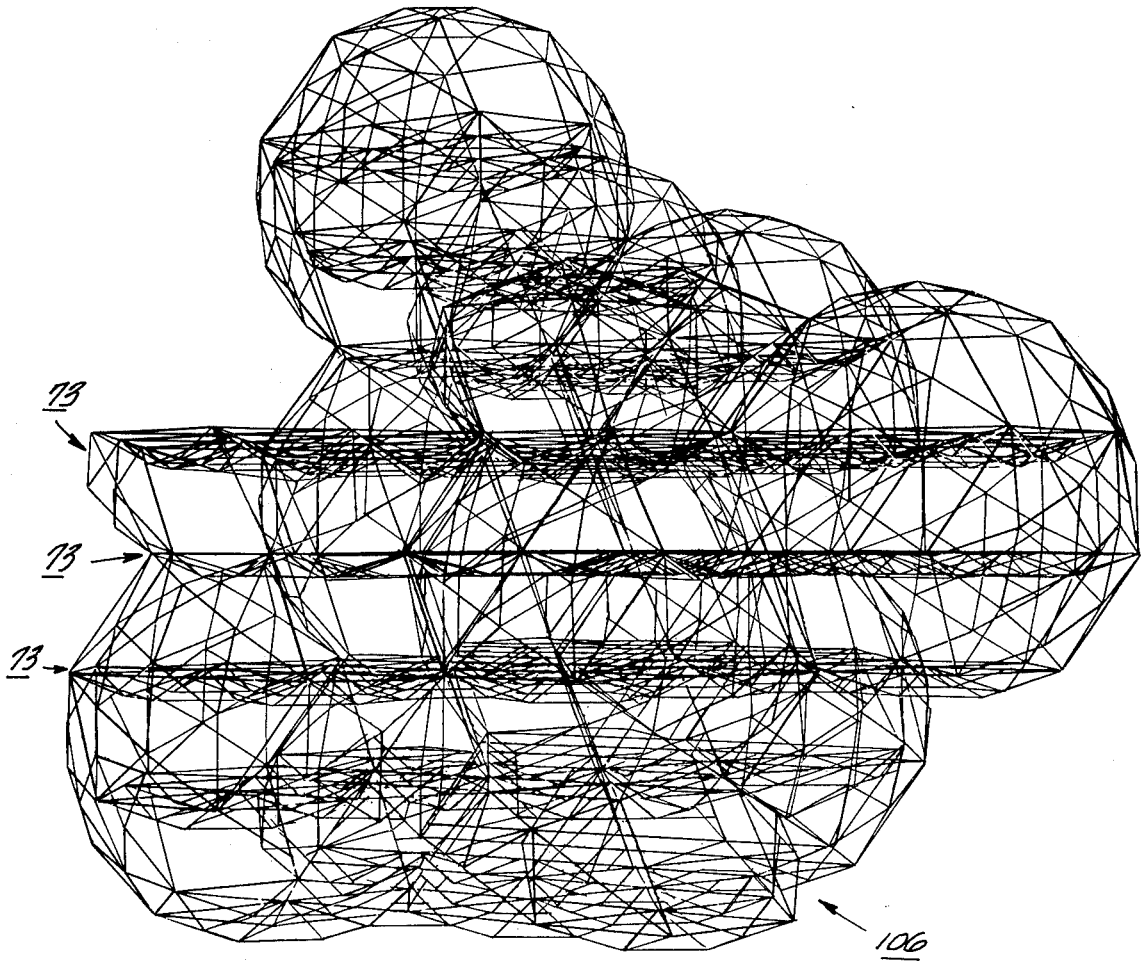
FIG. 27 is a perspective view of a skeletal framework for a multistory structure.

FIG. 27 shows, in elevation, a fully triangulated skeletal framework for an eight-story building 106. The geometry of this eight-story structure is derived from a packing of 10 full truncated octahedra 60 and six additional space units derived from the truncated octahedron 60. This configuration accounts for eight horizontal floor layers as is shown.

The spherical units used in this configuration provide more floor area per unit of exterior surface than conventional structures, and they have great inherent strength. It will be found that structural nodes are in vertical alignment and that interior structures such as elevator shafts could be easily installed, in spite of the unorthodox geometry.

FIG. 28 shows the overall floor plans of each of the eight levels of the structure. In high rise structures of this kind, it would be desirable to increase the length of the (A) component 14 to approximately 13 feet to achieve proper ceiling heights. All other dimensions would then be modified accordingly.

It should be emphasized that with this system, if all structural nodes were multidirectional hinges, the structure would still remain completely rigid. The skeletal frame is fully stable and is composed entirely of (A), (B) and (C) component branches 14, 16, 18. With the exception of local bending loads, all stress in this structure is carried axially in the framework members. There are no bending moments induced.

It is important to realize that the tetrahex planar truss 73 layers, which form the floor structures contribute substantially to the overall stability of such a structure as they do not function exclusively as spans or beams. Within the structure, the inclined supporting columns are arranged in hexagonal groups of six equilateral triangles each, all interconnected and coplanar with the faces of the truncated octahedra. There is a remarkable interaction of forces in such a configuration exhibiting, once again, the synergism of triangulated structures.

An important aspect of the system of the present invention is its extraordinary capability for novel spatial arrangements. Spherical structural units can be connected by bridge-like structures for the innovative use of land. The bridge itself would be part of the enclosure.

On can envisage such environmental structures assembled on hillsides in such a way that minimum change in terms of site preparation is required. Such structures might actually hover or bridge over hillsides, touching down only a certain points thus preserving intact the natural terrain.

Referring back to FIG. 1, the system of the present invention has been used to create a model for a Child Development Center. The floor plan for the Center is shown in FIG. 17.

This model, illustrated in FIG. 1, includes a number of architectural details not described or illustrated herein. Special notice should be made of various entrance canopies which are assembled from the original parts shown in FIG. 3. In addition, the doorways and window opening are more fully developed than in other building examples presented herein.

In the model structure, the total floor area would, if built to full size, be 10,954 square feet of which 1,527 square feet is exterior porch. The total surface area of the building would be 17,325 square feet. In the enclosing sheels, there are 654 No. 2 panels 26; 326 No. 1 panels 34; and 8 No. 10 panels 98. It is interesting to note that there are almost twice as many No. 2 panels 36 as there are No. 1 panels 34, which are the second most frequently occuring panels.

The floor structure of this building is a simple tetrahex truss 73. It is envisioned that all required mechanical systems would be contained in the floor structure since it does provide considerable room for such functions. The floor truss is an integral structural component of the entire assembly of the environmental shells.

Thus, there has been shown a novel system for structures. Large spans and spaces as well as small, intimate spaces are possible with the same system and can exist in contiguity, e.g. within the same dwelling unit or within the same complex of units. A multiunit apartment complex can be created out of the same components as the dining hall or recreation areas that are part of the complex. Alternative "rooms" and sub-divisions are provided for by the geometric relationships inherent in the system.

Virtually any size or shape room is possible including rectangular and hexagonal plans with vertical or inclined walls. The modular grid upon which the various partition arrangements must be based is fundamentally triangular but it is combined with a multidirectional rectangular grid. This makes possible the subdivision of spaces into familiar room shapes as well as "newer" shapes which are related to the hexagonal geometry of the system. Room size and shape may be changed after assembly by rearranging partitioning. Additional rooms may be added to pre-existing structures.

Three dimensional triangulation of the system provides ideal conditions for the economical use of materials assuring very high strength per weight of invested materials. Because of the geometry of enclosure and floor configurations, the surface area per unit of floor area of the enclosing shells is typically 35% less than for structures based upon rectangular geometries. This constitutes a considerable savings in material. Because of its compatibility with sophisticated production methods, the system can use modern materials which cannot be taken advantage of in more conventional craft approaches to building. Metals and plastics can be used as well as production processes usually associated with the automobile and other consumer product industries.

New materials also mean improved performance and low maintenance cost. This is important to the basic concept of the system. The availability of practically indestructible new materials in conjunction with the capabilities inherent in the system itself, promises unlimited applicability to human housing needs. Many of the new materials which can be used in the system are applicable in all climates. It is anticipated that common components can be produced with excellent insulative and weather performance for virtually all climatic conditions. Standardization of materials as well as components results in greater economy.

Less surface area in the shell results in significant advantages for heating and air conditioning. As surface area per unit volume is reduced, less heat or cold is conducted and, therefore, less energy is required for cooling and heating.

Because of the small size of the component parts, the need for only limited use of heavy machinery for site preparation, and the short assembly time, the system will minimize delivery costs, clean-up costs, and losses due to theft and vandalism. Organization and scheduling are greatly simplified because of the small number of different component types. The simplicity of the system permits the use of unskilled and semi-skilled labor in on-site assembly work, yielding not only a substantial savings but also opening up a labor force heretofore untapped by the building industry.

The minimum inventory of standardized components will combine and permit to provide an infinite variety of architectural alternatives. With the same set of geometrically defined components, it is possible to build single family dwellings, multi-unit low rise apartments, as well as elevator serviced high-rise structures. Certain engineering and spatial constraints require some variation in the details and exact weight of components, but this is nominal. Because the system is geometrical and topologically defined, all components are holistically interrelated. To enlarge one linear dimension is to enlarge the entire system. Therefore, any adjustment in dimension which is needed to accommodate alternative applications is achieved without altering the rigor and total integration of the modular system.

The system can be easily changed after initial construction to meet new requirements that may emerge. With a minor rearrangement of components or set of components, a major change in the character and quality of the space can be achieved. The skeletal frame is fastened together with demountable joints so that changes in the structure can be made with relative ease. In the case of a single story dwelling, it is anticipated that the user can make many changes in the spatial configuration himself.

The structural autonomy and lightweight features of the system make it well suited to sites of varied topographic configurations and marginal geological conditions. The multi-directional modularity of the building system is such that an extraordinary accommodation to slopes of various grades is possible as a matter of course. Also, the combination of the fully triangulated framework and the integral foundation make the structures of the present invention particularly well suited to earthquake prone areas such as Southern California, as well as to severe weather conditions such as hurricanes, high winds, and extreme snow accumulation.

Whether in single story or multilevel complexes, the system has an integral floor/foundation structure which is designed as a total structural system without reference to the ground. For instance, these buildings would be completely rigid structures, even if they were floating in air or on water. The building need only be fastened to the ground at a minimum number of nodal points and needs only minimal site preparation. Elaborate foundations are completely unnecessary. This constitutes a considerable savings in materials, time and labor.

What is claimed as new is:

1. A triangulated convex dome structural module erected upon a planar base comprising:

a. a first regular hexagon in a first plane having sides equal to unit length A;

b. a series of six isosceles triangles, the sides of which meet in pairs at the vertices of said first regular hexagon, said sides of said first hexagon defining the base sides of said triangles, the apices of said triangles falling at points which define the vertices of a second, not necessarily planar, hexagon positioned above said first regular hexagon, the centers of said hexagons being vertically aligned; the sides of said triangles being equal in length to A $\sqrt{6/4}$, the sides of said second hexagon being equal to A $\sqrt{3/3}$; and c. six additional members connecting a central apex that is directly above said vertically aligned centers of said first and second hexagons to the said second hexagon.

2. A triangulated convex dome structural module as in claim 1, above, combined with six identical such hexagonal structural modules to define and enclose a full truncated octahedron.

3. A triangulated convex dome structural module as in claim 1, above, combined with six other hexagonal structural modules to define and enclose a full truncated octahedron.

4. A structural configuration comprising the dome of claim 1, above, wherein said dome is substantially self-supporting, said dome being formed from panels.

5. A structural configuration, comprising the dome of claim 1, above, wherein said dome is substantially self-supporting, said dome being formed by linear strut members.

6. A triangulated convex dome structural module erected upon a planar base comprising:

a. a first regular hexagon in a first plane having sides equal to unit length A;

b. a series of six isosceles triangles, the sides of which meet in pairs at the vertices of said first regular hexagon, said sides of said first hexagon defining the base sides of said triangles, the apices of said triangles falling at points which define the vertices of a second, not necessarily planar, hexagon positioned above said first regular hexagon, the centers of said hexagons being vertically aligned; the sides of said triangles being equal in length to A $\sqrt{2/2}$, the sides of said second hexagon being equal to A $\sqrt{3/3}$; and c. six additional members connecting a central apex that is directly above said vertically aligned centers of said first and second hexagons to said second hexagon.

7. A triangulated convex dome structural module as in claim 6, above, combined with six identical such hexagonal structural modules to define and enclose a full truncated octahedron.

8. A triangulated convex dome structural module as in claim 6, above, combined with six other hexagonal structural modules to define and enclose a full truncated octahedron.

9. A structural configuration comprising dome of claim 6, above, wherein said dome is substantially self-supporting, said dome being formed from panels.

10. A structural configuration comprising the dome of claim 6, above, wherein said dome is substantially self-supporting, said dome being formed by linear strut members.

11. A triangulated convex dome structural module erected upon a planar base comprising:

a. a first regular hexagon in a first plane having sides equal to unit length A;

b. a series of six isosceles triangles, the sides of which meet in pairs at the vertices of said first regular hexagon, said sides of said first hexagon defining the base sides of said triangles, the apices of said isosceles triangles falling at points which define the vertices of a second, not necessarily planar, hexagon, positioned above said first regular hexagon, the centers of said hexagons being vertically aligned; the sides of three of said six isosceles triangles being equal in length to A $\sqrt{6/4}$ and the sides of three other of said isosceles triangles being equal in length to A $\sqrt{2/2}$, the sides of said second hexagon being equal to A $\sqrt{6/4}$; and c. six additional members connecting a central apex that is directly above said vertically aligned centers of said first and second hexagons to said second hexagon.

12. A triangulated convex dome structural module as in claim 11, above, combined with six identical such hexagonal structural modules to define and enclose a full truncated octahedron.

13. A triangulated convex dome structural module as in claim 11, above, combined with six other hexagonal structural modules to define and enclose a full truncated octahedron.

14. A structural configuration comprising the dome of claim 11, above, wherein said dome is substantially self-supporting, said dome being formed from panels.

15. A structural configuration comprising the dome of claim 11, above, wherein said dome is substantially self-supporting, said dome being formed by linear strut members.

16. A triangulated convex dome structural module erected upon a planar base comprising:

a. a first regular hexagon in a first plane having sides equal to unit length A;

b. a series of six isosceles triangles, the sides of which meet in pairs at the vertices of said first regular hexagon, said sides of said first hexagon defining the base sides of said triangles, the apices of said isosceles triangles falling at points which define the vertices of a second, not necessarily planar, hexagon, positioned above said first regular hexagon, the centers of said hexagons being vertically aligned; the sides of two of said six isosceles triangles being equal in length to A $\sqrt{6/4}$, the sides of four other of said six isosceles triangles being equal in length to A $\sqrt{2/2}$, two of the sides of said second hexagon being equal to A $\sqrt{3/3}$, four of the sides of said second hexagon being equal to A $\sqrt{6/4}$; and c. six additional members connecting a central apex that is directly above said vertically aligned centers of said first and second hexagons to said second hexagon.

17. A triangulated convex dome structural module as in claim 16, above, combined with six identical such hexagonal structural modules to define and enclose a full truncated octahedron.

18. A triangulated convex dome structural module as in claim 16, above, combined with six other hexagonal structural modules to define and enclose a full truncated octahedron.

19. A structural configuration comprising the dome of claim 16, above, wherein said dome is substantially self-supporting, said dome being formed from panels.

20. A structural configuration comprising the dome of claim 16, above, wherein said dome is substantially self-supporting, said dome being formed by linear strut members.

21. A triangulated convex dome structural module erected upon a planar base comprising:

a. a first regular hexagon in a first plane having sides equal to unit length A;

b. a series of six isosceles triangles, the sides of which meet in pairs at the vertices of said first regular hexagon, said sides of said first hexagon defining the base sides of said triangles, the apices of said isosceles triangles falling at points which define the vertices of a second, not necessarily planar, hexagon, positioned above said first regular hexagon, the centers of said hexagons being vertically aligned; the sides of two of said six isosceles triangles being equal in length to A $\sqrt{6/4}$, the sides of four other of said six isosceles triangles being equal in length to A $\sqrt{2/2}$, two of the sides of said second hexagon being equal to A $\sqrt{3/3}$, four of the sides of said second hexagon being equal to A $\sqrt{6/4}$; and c. six additional members connecting a central apex that is directly above said vertically aligned centers of said first and second hexagons to said second hexagon.

22. A triangulated convex dome structural module as in claim 21, above, combined with six identical such hexagonal structural modules to define and enclose a full truncated octahedron.

23. A triangulated convex dome structural module as in claim 21, above, combined with six other hexagonal structural modules to define and enclose a full truncated octahedron.

24. A structural configuration comprising the dome of claim 21, above, wherein said dome is substantially self-supporting, said dome being formed from panels.

25. A structural configuration comprising the dome of claim 21, above, wherein said dome is substantially self-supporting, said dome being formed by linear strut members.

26. A triangulated convex-concave dome structural module erected upon a planar base comprising:

a. a first symmetrical irregular nonagon in a first plane, having sides equal to arbitrary unit length A with three alternating collinear pairs of sides and three additional sides between said collinear paired sides forming nine interior angles, respectively: 120°, 180°, 120°, 120°, 180°, 120°, 120°, 180°, and 120°;

b. a series of 9 isosceles triangles, the sides of which meet in pairs at the vertices of said first nonagon in said first plane, the sides of said first nonagon defining the base sides of the triangles, the sides of said triangles being equal in length to A $\sqrt{6/4}$;

c. three respective sets of three vertices each being defined by the apices of said isosceles triangles which are common to three corresponding vertices of three respective regular, not necessarily planar hexagons said three hexagons being arranged around a common point vertically positioned above the center of said irregular nonagon in said first plane, sharing three common edges emanating from said common point, said common edges terminating at three respective vertices shared by respective pairs of said hexagons, the sides of said hexagons being equal in length to A $\sqrt{3/3}$;

d. three members connecting the respective vertices common to each of said three alternating collinear pairs of sides of said first nonagon, to said three respective vertices shared by respective pairs of said hexagons arranged around a common point, the length of said three members being A $\sqrt{6/4}$; and e. eighteen additional strut members in three respective groups of six each, respectively erected upon said set of three hexagons and arranged around a common point, such that three hexagonal pyramids are formed, the apices of which fall vertically above the respective centers of said hexagons, arranged around a common point.

27. A triangulated convex-concave dome structural module as in claim 26. above, in combination with three hexagonal structural modules and three pentagonal structural modules to form and enclose an equatorial space unit of a truncated octahedron positioned atop a polar space unit of a truncated octahedron.

28. A structural configuration comprising the dome of claim 26, above, wherein said dome is substantially self-supporting, said dome being formed from panels.

29. A structural configuration comprising the dome of claim 26, above, wherein said dome is substantially self-supporting, said dome being formed by linear strut members.

30. A triangulated convex-concave dome structural module erected upon a planar base comprising:

a. a first symmetrical irregular nonagon in a first plane, having sides equal to arbitrary unit length A with three alternating collinear pairs of sides and three additional sides between said collinear paired sides forming nine interior angles, respectively: 120°, 180°, 120°, 120°, 180°, 120°, 120°, 180°, and 120°;

b. a series of 9 isosceles triangles, the sides of which meet in pairs at the vertices of said first nonagon in said first plane, the sides of said first nonagon defining the base sides of said triangles, the sides of said triangles being equal in length A $\sqrt{2/2}$;

c. three respective sets of three vertices each being defined by the apices of said isosceles triangles which are common to three corresponding vertices of three respective regular, not necessarily planar hexagons, said three hexagons being arranged around a common point vertically positioned above the center of said irregular nonagon in said first plane, sharing three common edges emanating from said common point, said common edges terminating at three respective vertices shared by respective pairs of said hexagons the sides of said hexagons being equal in length to A $\sqrt{3/3}$;

d. three members connecting the respective vertices common to each of said three alternating collinear pairs of sides of said first nonagon, to said three respective vertices shares by respective pairs of said hexagons arranged around a common point, the length of said three members being A $\sqrt{2/2}$; and e. eighteen additional strut members in three respective groups of six each, respectively erected upon said set of three hexagons and arranged around a common point, such that three hexagonal pyramids are formed, the apices of which fall vertically above the respective centers of said hexagons arranged around a common point.

31. A triangulated convex-concave dome structural module as in claim 26, above, in combination with three hexagonal frame modules and three pentagonal structural modules to form and enclose an equatorial space unit of a truncated octahedron positioned atop a polar space unit of a truncated octahedron.

32. A structural configuration comprising the dome of claim 30, above, wherein said dome is substantially self-supporting, said dome being formed from panels.

33. A structural configuration comprising the dome of claim 30, above, wherein said dome is substantially self-supporting, said dome being formed by linear strut members.

34. A triangulated convex-concave dome structural module erected upon a planar base comprising:

a. a first symmetrical irregular nonagon in a first plane, having sides equal to arbitrary unit length A with three alternating collinear pairs of sides and three additional sides between said collinear paired sides forming nine interior angles, respectively: 120°, 180°, 120°, 120°, 180°, 120°, 120°, 180°, and 120°;

b. a series of 9 isosceles triangles, the sides of which meet in pairs at the vertices of said first nonagon in said first plane, the sides of said first nonagon defining the base sides of said triangles, the sides of six of said 9 isosceles triangles being equal in length A $\sqrt{2/2}$, the sides of three other of said 9 isosceles triangles being equal in length to A $\sqrt{6/4}$;

c. three respective sets of three vertices each being defined by the apices of said isosceles triangles which are common to three corresponding vertices of three respective regular, not necessarily planar hexagons said three hexagons being arranged around a common point vertically positioned above the center of said irregular nonagon in said first plane, sharing three common edges emanating from said common point, said common edges terminating at three respective vertices shared by respective pairs of said hexagons, the sides of said hexagons being equal in length to A $\sqrt{6/4}$;

d. three members connecting the respective vertices common to each of said three alternating collinear pairs of sides of said first nonagon, to said three respective vertices shares by respective pairs of said hexagons arranged around a common point, the length of said three members being A $\sqrt{2/2}$; and e. eighteen additional strut members in three respective groups of six each, respectively erected upon said set of three hexagons and arranged around a common point, such that three hexagonal pyramids are formed, the apices of which fall vertically above the respective centers of said hexagons arranged around a common point.

35. A triangulated convex-concave dome structural module as in claim 34, above, in combination with three hexagonal frame modules and three pentagonal structural modules to form and enclose an equatorial space unit of a truncated octahedron positioned atop a polar space unit of a truncated octahedron.

36. A structural configuration comprising the dome of claim 34, above, wherein said dome is substantially self-supporting, said dome being formed from panels.

37. A structural configuration comprising the dome of claim 35, above, wherein said dome is substantially self-supporting, said dome being formed by linear strut members.

38. A triangulated convex-concave dome structural module erected upon a planar base comprising:

a. a first symmetrical irregular nonagon in a first plane, having sides equal to arbitrary unit length A with three alternating collinear pairs of sides and three additional sides between said collinear paired sides forming nine interior angles, respectively: 120°, 180°, 120°, 120°, 180°, 120°, 120°, 180°, and 120°;

b. a series of 9 isosceles triangles, the sides of which meet in pairs at the vertices of said first nonagon in said first plane, the sides of said first nonagon defining the base sides of said triangles, the sides of six of said 9 isosceles triangles being equal in length A $\sqrt{6/4}$, the sides of three other of said 9 isosceles triangles being equal in length to A $\sqrt{2/2}$;

c. three respective sets of three vertices each being defined by the apices of said isosceles triangles which are common to three corresponding vertices of three respective regular, not necessarily planar hexagons said three hexagons being arranged around a common point vertically positioned above the center of said irregular nonagon in said first plane, sharing three common edges emanating from said common point, said common edges terminating at three respective vertices shared by respective pairs of said hexagons, the sides of said hexagons being equal in length to A $\sqrt{6/4}$;

d. three members connecting the respective vertices common to each of said three alternating collinear pairs of sides of said first nonagon, to said three respective vertices shared by respective pairs of said hexagons arranged around a common point, the length of said three members being A $\sqrt{2/2}$ and e. eighteen additional strut members in three respective groups of six each, respectively erected upon said set of three hexagons and arranged around a common point, such that three hexagonal pyramids are formed, the apices of which fall vertically above the respective centers of said hexagons arranged around a common point.

39. A triangulated convex-concave dome structural module as in claim 38, above, in combination with three hexagonal frame modules and three pentagonal structural modules to form and enclose an equatorial space unit of a truncated octahedron positioned atop a polar space unit of a truncated octahedron.

40. A structural configuration comprising the dome of claim 38, above, wherein said dome is substantially self-supporting, said dome being formed from panels.

41. A structural configuration comprising the dome of claim 38, above, wherein said dome is substantially self-supporting, said dome being formed by linear strut members.

42. A triangulated convex concave dome structural module erected upon a planar base comprising:

a. a first irregular, symmetrical octagon in a first plane having sides equal to unit length A with two parallel and opposed sets of collinear paired sides, and with two opposed sets of obtuse paired sides, forming eight interior angles respectively: 120°, 120°, 180°, 120°, 120°, 120°, 180°, and 120°.

b. a series of eight isosceles triangles, the sides of which meet in pairs at the vertices of said first octagon in said first plane, such that the sides of said first octagon form the base sides of said isosceles triangles, the sides of said isosceles triangles being equal in length to A $\sqrt{6/4}$;

c. two respective sets of four vertices each which are common to four corresponding vertices of two respective, contiguous regular, not necessarily planar, hexagons positioned above said first plane, being defined by the apices of said isosceles triangles, said regular hexagons sharing a common edge and a pair of vertices at the ends of said common edge, the sides of said regular hexagons being equal in length to A $\sqrt{3/3}$;

d. two strut members connecting the respective vertices common to each of said two parallel and opposed sets of collinear paired sides of said first octagon in said first plane to the respective vertices at the ends of said common edge shared by said contiguous pair or regular hexagons positioned above said first plane, the lengths of said two strut members being A $\sqrt{6/4}$; and e. twelve additional strut members in two groups of six each, respectively erected upon said contiguous pair of regular hexagons positioned above first plane, forming two hexagonal pyramids, the apices of which fall vertically above the respective centers of said regular hexagons.

43. A structural configuration comprising the dome of claim 42, above, wherein said dome is substantially self-supporting, said dome being formed from panels.

44. A structural configuration comprising the dome of claim 42, above, wherein said dome is substantially self-supporting, said dome being formed by linear strut members.

45. A triangulated convex concave dome structural module erected upon a planar base comprising:

a. a first irregular, symmetrical octagon in a first plane having sides equal to unit length A with two parallel and opposed sets of collinear paired sides, and with two opposed sets of obtuse paired sides, forming eight interior angles respectively: 120°, 120°, 180°, 120°, 120°, 120°, 180°, and 120°.

b. a series of eight isosceles triangles, the sides of which meet in pairs at the vertices of said first octagon in said first plane, such that the sides of said first octagon form the base sides of said isosceles triangles, the sides of said isosceles triangles being equal in length to A $\sqrt{2/2}$;

c. two respective sets of four vertices each which are common to four corresponding vertices of two respective, contiguous regular, not necessarily planar, hexagons positioned above said first plane, being defined by the apices of said isosceles triangles, said regular hexagons sharing a common edge and a pair of vertices at the ends of said common edge, the sides of said regular hexagons being equal in length to A $\sqrt{3/3}$;

d. two strut members connecting the respective vertices common to each of said two parallel and opposed sets of collinear paired sides of said first octagon in said first plane to the respective vertices at the ends of said common edge shared by said contiguous pair or regular hexagons positioned above said first plane, the lengths of said two strut members being A $\sqrt{2/2}$; and e. twelve additional strut members in two groups of six each, respectively erected upon said contiguous pair of regular hexagons positioned above first plane, forming two hexagonal pyramids, the apices of which fall vertically above the respective centers of said regular hexagons.

46. A structural configuration comprising the dome of claim 45, above, wherein said dome is substantially self-supporting, said dome being formed from panels.

47. A structural configuration comprising the dome of claim 45, above, wherein said dome is substantially self-supporting, said dome being formed by linear strut members.

48. A triangulated convex concave dome structural module erected upon a planar base comprising:

a. a first irregular, symmetrical octagon in a first plane having sides equal to unit length A with two parallel and opposed sets of collinear paired sides, and with two opposed sets of obtuse paired sides, forming eight interior angles respectively: 120°, 120°, 180°, 120°, 120°, 120°, 180°, and 120°.

b. a series of eight isosceles triangles, the sides of which meet in pairs at the vertices of said first octagon in said first plane, such that the sides of said first octagon form the base sides of said isosceles triangles, the sides of four of said eight isosceles triangles being equal in length to A $\sqrt{6/4}$ the sides of four other of said eight isoceles triangles being equal in length to A $\sqrt{2/2}$;

c. two respective sets of four vertices each of which are common to four corresponding vertices of two respective, contiguous regular, not necessarily planar, hexagons positioned above said first plane, being defined by the apices of said isosceles triangles, said regular hexagons sharing a common edge and a pair of vertices at the ends of said common edge, the sides of said regular hexagons being equal in length to A $\sqrt{6/4}$;

d. two strut members connecting the respective vertices common to each of said two parallel and opposed sets of collinear paired sides of said first octagon in said first plane to the respective vertices at the ends of said common edge shared by said contiguous pair of regular hexagons positioned above said first plane, the lengths of said two strut members being equal in length respectively to A $\sqrt{2/2}$; and e. twelve additional strut members in two groups of six each, respectively erected upon said contiguous pair of regular hexagons positioned above first plane, forming two hexagonal pyramids, the apices of which fall vertically above the respective centers of said regular hexagons.

49. A structural configuration comprising the dome of claim 48, above, wherein said dome is substantially self-supporting, said dome being formed from panels.

50. A structural configuration comprising the dome of claim 48, above, wherein said dome is substantially self-supporting, said dome being formed by linear strut members.

51. A triangulated convex-concave dome structural module erected upon a planar base comprising:

a. a first irregular, symmetrical pentagon in a first plane, having sides equal to unit length A, with one collinear pair of sides and three additional sides forming five interior angles, respectively: 120°, 60°, 180°, 60°, and 120°;

b. a series of five isosceles triangles, the sides of which meet in pairs at the vertices of said pentagon in said first plane, the sides of said pentagon defining the base sides of said isosceles triangles, the sides of said isosceles triangles being equal in length to A $\sqrt{6/4}$ two pairs of said isosceles triangles sharing respective vertices which occur at said 60° interior angles of said pentagon, a common edge and a common apex for each of said pair of isosceles triangles forming a first and second apex, a third apex being defined by a fifth said isosceles triangle;

c. a member joining said third apex to the vertex common to said collinear pair of sides of said pentagon, said member being equal in length to A $\sqrt{6/4}$; and d. two additional members joining respectively said first apex with said third apex and said second apex with said third apex, said third apex being common to both additional members, and said additional members being equal in length to A $\sqrt{3/3}$.

52. A structural configuration comprising the dome of claim 51, above, wherein said dome is substantially self-supporting, said dome being formed from panels.

53. A structural configuration comprising the dome of claim 51, above, wherein said dome is substantially self-supporting, said dome being formed by linear strut members.

54. A triangulated dome structural module as in claim 51, above, joined with two similar structural modules, a hexagonal dome module and a base plane to define a polar space unit of a truncated octahedron.

55. A triangulated dome structural module as in claim 51, above, joined with two identical modules, a nonagonal dome module and a base plane to define the equatorial space unit of the truncated octahedron.

56. A triangulated dome structural module as in claim 51, above, combined with two additional such modules, a base plane and four hexagonal dome modules to define a polar space unit of a truncated octahedron positioned atop an equatorial space unit from a truncated octahedron.

57. A triangulated dome structural module as in claim 51, above, combined with two substantially identical structural modules to define secondary wall regions, an irregular, symmetrical honagonal dome structural module defining an upper roof region, an irregular symmetrical octagon dome module defining primary wall regions and a base plane, whereby a triangulated dome structure is formed.

58. A triangulated convex-concave dome structural module erected upon a planar base comprising:

a. a first irregular, symmetrical pentagon in a first plane, having sides equal to unit length A, with one collinear pair of sides and three additional sides forming five interior angles, respectively: 120°, 60°, 180°, 60°and 120°;

b. a series of five isosceles triangles, the sides of which meet in pairs at the vertices of said pentagon in said first plane, the sides of said pentagon defining the base sides of said isosceles triangles, the sides of said isosceles triangles being equal in length to A $\sqrt{2/2}$, two pairs of said isosceles triangles sharing respective vertices which occur at said 60° interior angles of said pentagon, a common edge and a common apex for each of said pair of isosceles triangles forming a first and second apex, a third apex being defined by a fifth said isosceles triangle;

c. a member joining said third apex to the vertex common to said collinear pair of sides of said pentagon, said edge module being equal in length to A $\sqrt{2/2}$; and d. two additional members joining respectively said first apex with said third apex and said second apex with said third apex, said third apex being common to both additional members and said additional members being equal in length to A $\sqrt{3/3}$.

59. A structural configuration comprising the dome of claim 58, above, wherein said dome is substantially self-supporting, said dome being formed from panels.

60. A structural configuration comprising the dome of claim 58, above, wherein said dome is substantially self-supporting, said dome being formed by linear strut members.

61. A triangulated dome structural module as in claim 58, above, joined with two similar structural modules, a hexagonal dome module and a base plane to define a polar space unit of a truncated octahedron.

62. A triangulated dome structural module as in claim 58, above, joined with two identical modules, a nonagonal dome module and a base plane to define the equatorial space unit of the truncated octahedron.

63. A triangulated dome structural module as in claim 58, above, combined with two additional such modules, a base plane and four hexagonal dome modules to define a polar space unit of a truncated octahedron positioned atop an equatorial space unit from a truncated octahedron.

64. A triangulated dome structural module as in claim 58, above, combined with two substantially identical structural modules to define secondary wall regions, an irregular, symmetrical nonagon dome structural module defining an upper roof region, an irregular symmetrical octagon dome module defining primary wall regions and a base plane, whereby a triangulated dome structure is formed.

65. A triangulated convex-concave dome structural module erected upon a planar base comprising:

a. a first irregular, symmetrical pentagon in a first plane, having sides equal to unit length A, with one collinear pair of sides and three additional sides forming five interior angles, respectively: 120°, 60°, 180°, 60°, and 120°;

b. a series of five isosceles triangles, the sides of which meet in pairs at the vertices of said pentagon in said first plane, the sides of said pentagon defining the base sides of said isosceles triangles, the sides of four or said five isosceles triangles being equal in length to A $\sqrt{6/4}$, two pairs of said isosceles triangles sharing respective vertices which occur at said 60° interior angles of said pentagon, a common edge and a common apex for each of said pair of isosceles triangles forming a first and second apex, a third apex being defined by a fifth said isosceles triangle, the sides of said fifth isosceles triangle being equal in length to A $\sqrt{2/2}$;

c. a member joining said third apex to the vertex common to said collinear pair of sides of said pentagon, said member being equal in length to A $\sqrt{2/2}$; and d. two additional members joining respectively said first apex with said third apex and said second apex with said third apex, said third apex being common to both additional members, and said additional members being equal in length to A $\sqrt{6/4}$.

66. A structural configuration comprising the dome of claim 65, above, wherein said dome is substantially self-supporting, said dome being formed from panels.

67. A structural configuration comprising the dome of claim 65, above, wherein said dome is substantially self-supporting, said dome being formed by linear strut members.

68. A triangulated dome structure module as in claim 65, above, joined with two similar structural modules, a hexagonal dome module and a base plane to define a polar space unit of a truncated octahedron.

69. A triangulated dome structural module as in claim 65, above, joined with two identical modules, a nonagonal dome module and a base plane to define the equatorial space unit of the truncated octahedron.

70. A triangulated dome structural module as in claim 65, above, combined with two additional such modules, a base plane and four hexagonal dome modules to define a polar space unit of a truncated octahedron positioned atop an equatorial space unit from a truncated octahedron.

71. A triangulated dome structural module as in claim 65, above, combined with two substantially identical structural modules to define secondary wall regions, an irregular, symmetrical nonagon dome structural module defining an upper roof region, an irregular symmetrical octagon dome module defining primary wall regions and a base plane, whereby a triangulated dome structure is formed.

72. A triangulated convex-concave dome structural module erected upon a planar base comprising:

a. a first irregular, symmetrical pentagon in a first plane, having sides equal to unit length A, with one collinear pair of sides and three additional sides forming five interior angles, respectively: 120°, 60°, 180°, 60°, and 120°;

b. a series of five isosceles triangles, the sides of which meet in pairs at the vertices of said pentagon in said first plane, the sides of said pentagon defining the base sides of said isosceles triangles, the sides of four or said five isosceles triangles being equal in length to A $\sqrt{2/2}$, two pairs of said isosceles triangles sharing respective vertices which occur at said 60° interior angles of said pentagon, a common edge and a common apex for each of said pair of isosceles triangles forming a first and second apex, a third apex being defined by a fifth said isosceles triangle, the sides of said fifth isosceles triangle being equal in length to A $\sqrt{6/4}$;

c. a member joining said third apex to the vertex common to said collinear pair of sides of said pentagon, said member being equal in length to A $\sqrt{6/4}$; and d. two additional members joining respectively said first apex with said third apex and said second apex with said third apex, said third apex being common to both said additional members, and said additional members being equal in length to A $\sqrt{6/4}$.

73. A structural configuration comprising the dome of claim 72, above, wherein said dome is substantially self-supporting, said dome being formed from panels.

74. A structural configuration comprising the dome of claim 72, above, wherein said dome is substantially self-supporting, said dome being formed by linear strut members.

75. A triangulated dome structural module as in claim 72, above, joined with two similar structural modules, a hexagonal dome module and a base plane to define a polar space unit of a truncated octahedron.

76. A triangulated dome structural module as in claim 72, above, joined with two identical modules, nonagonal dome module and a base plane to define the equatorial space unit of the truncated octahedron.

77. A triangulated dome structural module as in claim 72, above, combined with two additional such modules, a base plane and four hexagonal dome modules to define a polar space unit of a truncated octahedron positioned atop an equatorial space unit from a truncated octehedron.

78. A triangulated dome structural module as in claim 72, above, combined with two substantially identical structural modules to define secondary wall regions, an irregular, symmetrical nonagon dome structural module defining an upper roof region, an irregular symmetrical octagon dome module defining primary wall regions and a base plane, whereby a triangulated dome structure is formed.

79. A repeating triangulated planar structure comprising:

a. a repeating planar array of equilateral triangles having sides equal to unit length A;

b. a repeating array of equal tripods constructed upon each of said equilateral triangles such that a repeating array of coplanar triangular pyramids is formed, the apices of said pyramids being vertically above the centers of said equilateral triangles, each pyramid being bounded by three equal isosceles triangular faces, the sides of which are equal in length to A $\sqrt{6/4}$; and c. a plurality of equal length members joining the apices of said pyramids for forming an array of copolanar regular hexagons, three of said members meeting at each apex of said pyramids, and the length of said members being A $\sqrt{3/3}$.

80. A structural configuration comprising the structure of claim 79, above, wherein said structure is substantially self-supporting, said structure being formed from panels.

81. A structural configuration comprising the structure of claim 79, above, wherein said structure is substantially self-supporting, said structure being formed by linear strut members.

82. A repeating triangulated planar structure comprising:

a. a repeating planar array of equilateral triangles having sides equal to unit length A;

b. a repeating array of equal tripods constructed upon each of said equilateral triangles such that a repeating array of coplanar triangular pyramids is formed, the apices of said pyramids being vertically above the centers of said equilateral triangles, each pyramid being bounded by three equal isosceles triangular faces, the sides of which are equal in length to A $\sqrt{2/2}$; and c. a plurality of equal length members joining the apices of said pyramids for forming an array of coplanar regular hexagons, three of said members meeting at each apex of said pyramids, and the length of said members being A $\sqrt{3/3}$.

83. A structural configuration comprising the structure of claim 82, above, wherein said structure is substantially self-supporting, said structure being formed from panels.

84. A structural configuration comprising the structure of claim 80, above, wherein said structure is substantially self-supporting, said structure being formed by linear strut members.

85. A repeating triangulated planar variable depth framework structure comprising:

a. a first repeating hexagonal frame defined by a planar array of regular hexagons in a first plane, said hexagons having sides equal to A $\sqrt{3/3}$ where A is a unit length;

b. a second, repeating hexagonal frame defined by a planar array of said regular hexagons in a second plane, said second repeating hexagonal frame being vertically aligned over and parallel to said first repeating hexagonal frame;

c. a plurality of parallel strut members joining respective vertices of said first repeating hexagonal frame with respective vertices of said second repeating hexagonal frame, said parallel strut members being perpendicular to said first and second repeating hexagonal frames, and said parallel strut members being equal in length to A $\sqrt{6/6}$;

d. a plurality of first inclined strut members arranged in groups of six, radiating from common apices to form a set of first hexagonal pyramids which are erected upon said first repeating hexagonal frame, the apices of said set of first hexagonal pyramids defining a common plane parallel and intermediate to said first and second repeating hexagonal frames, the length of said first inclined strut members being equal to A $\sqrt{6/4}$; and e. a plurality of second inclined strut members arranged in groups of six, radiating from common apices to form a set of second hexagonal pyramids which are erected upon said second repeating hexagonal frame, the apices of said set of second hexagonal pyramids defining a common plane parallel and intermediate to said first and second repeating hexagonal frames, the respective apices of said set of second hexagonal pyramids exactly coinciding with respective apices of said set of first hexagonal pyramids, the length of said second inclined strut members being equal to A $\sqrt{6/4}$.

86. A repeating triangulated planar variable depth framework structure comprisng:

a. a first repeating hexagonal frame defined by a planar array of regular hexagons in a first plane, said hexagons having sides equal to A $\sqrt{3/3}$ where A is a unit length;

b. a second, repeating hexagonal frame defined by a planar array of said regular hexagons in a second plane, said second repeating hexagonal frame being vertically aligned over and parallel to said first repeating hexagonal frame;

c. a plurality of parallel strut members joining respective vertices of said first repeating hexagonal frame with respective vertices of said second repeating hexagonal frame, said parallel strut members being perpendicular to said first and second repeating hexagonal frames, and said parallel strut members being equal in length to A $\sqrt{6/4}$;

d. a plurality of first inclined strut members arranged in groups of six, radiating from common apices to form a set of first hexagonal pyramids which are erected upon said first repeating hexagonal frame, the apices of said set of first hexagonal pyramids defining a common plane parallel and intermediate to said first and second repeating hexagonal frames, the length of said first inclined strut members being equal to A $\sqrt{6/4}$; and e. a plurality of second inclined strut members arranged in groups of six, radiating from common apices to form a set of second hexagonal pyramids which are erected upon said second hexagonal frame, the apices of said set of second hexagonal pyramids defining a common plane parallel and intermediate to said first and second repeating hexagonal frames, the respective apices of said set of second hexagonal pyramids exactly coinciding with respective apices of said set of first hexagonal pyramids, the length of said second inclined strut members being equal to A $\sqrt{2/2}$.

87. The triangulated polyhedral structures comprising truncations of a complete polyhedral structure of eighty-four quadrilateral faces, the complete polyhedral structure comprising:

a. twelve first rhombic faces, the sides of which are equal in length to A $\sqrt{6/4}$, the long diagonal of said first rhombic face being equal to unit length A and the short diagonal of said first rhombic face being equal in length to A $\sqrt{2/2}$, said long diagonal dividing said first rhombic face into a pair of identical isosceles triangles which share a common base of unit length A, and said short diagonal dividing said first rhombic face into a pair of identical isosceles triangles which share a common base of length A $\sqrt{2/2}$;

b. forty-eight, second rhombic faces, the sides of which are equal in length of A $\sqrt{6/4}$, the long diagonal of said second rhombic face being equal in length to A $\sqrt{42/6}$, and the short diagonal of said second rhombic face being equal in length to A $\sqrt{3/3}$, said long diagonal dividing said second rhombic face into a pair of identical isosceles triangles which share a common base of length A $\sqrt{42/6}$, and said short diagonal dividing said second rhombic face into a pair of identical isosceles triangles which share a common base of length A $\sqrt{3/3}$; and c. twenty-four trapezium faces each having two sides equal in length to A$\sqrt{6/4}$ and two sides equal in length to A$\sqrt{34/8}$, the long diagonal of said trapezium face being equal to unit length A, and the short diagonal of said trapezium face being equal in length to A 5 $\sqrt{2/8}$, said long diagonal dividing said trapezium into a pair of first and second isosceles triangles which share a common base of unit length A, said first isosceles triangle having sides of A $\sqrt{6/4}$, and said second isosceles triangle having sides of A $\sqrt{34/8}$, and said short diagonal dividing said trapezium face into a pair of identical but reversed scalene triangles sharing a common side of 5 $\sqrt{2/8}$, and having two other sides of A $\sqrt{6/4}$ and A $\sqrt{34/8}$.

88. A structural configuration comprising the structure of claim 87, above, wherein said structure is substantially self-supporting, said structure being formed from panels.

89. A structural configuration comprising the structure of claim 87, above, wherein said structure is substantially self-supporting, said structure being formed by linear strut members.

* * * * *

UNITED STATES PATENT OFFICE
CERTIFICATE OF CORRECTION

Patent No. 3,974,600 Dated August 17, 1976

Inventor(s) Peter J. Pearce

It is certified that error appears in the above-identified patent and that said Letters Patent are hereby corrected as shown below:

Column 1, line 46, change "that" to read "than".

Column 3, Table I - B: should be .6124A
Table I - D: should be .7071A

Column 8, line 50, change "complete" to read "completely".

Column 15: Table IV: G = 1.0801A

Column 17, line 33, change "On" to "One".

In the Claims:

Throughout the Claims, fractions have been erroneously printed in the form of $\sqrt{x/y}$. All such instances should be corrected to read $\sqrt{x/y}$, where "x" is the numerator and "y" is the denominator. The affected claims are:

| | |
|---|---|
| 1. | 48. |
| 6. | 51. |
| 11. | 58. |
| 16. | 65. |
| 21. | 72. |
| 26. | 79. |
| 30. | 82. |
| 34. | 85. |
| 38. | 86. |
| 42. | 87. |
| 45. | |

Signed and Sealed this

Twenty-first Day of December 1976

[SEAL]

*Attest:*

RUTH C. MASON
*Attesting Officer*

C. MARSHALL DANN
*Commissioner of Patents and Trademarks*